US010016101B2

(12) United States Patent
Schottenstein et al.

(10) Patent No.: US 10,016,101 B2
(45) Date of Patent: Jul. 10, 2018

(54) TOILET CHAIR ASSEMBLY

(71) Applicant: ALBI DESIGN I LLC, Los Angeles, CA (US)

(72) Inventors: Aryeh Leib Schottenstein, Los Angeles, CA (US); Marcy Elizabeth Kelly, Los Angeles, CA (US)

(73) Assignee: Albi Design I LLC, Los Angeles, CA (US)

( * ) Notice: Subject to any disclaimer, the term of this patent is extended or adjusted under 35 U.S.C. 154(b) by 337 days.

(21) Appl. No.: 14/519,073

(22) Filed: Oct. 20, 2014

(65) Prior Publication Data

US 2015/0196178 A1 Jul. 16, 2015

Related U.S. Application Data

(63) Continuation of application No. 14/080,791, filed on Nov. 14, 2013, now Pat. No. 8,863,321.

(60) Provisional application No. 61/726,479, filed on Nov. 14, 2012.

(51) Int. Cl.

| | |
|---|---|
| ***A47K 13/00*** | (2006.01) |
| ***A47K 13/24*** | (2006.01) |
| ***A47C 7/62*** | (2006.01) |
| ***A47C 15/00*** | (2006.01) |
| ***A47K 17/02*** | (2006.01) |

(52) U.S. Cl.

CPC ..... *A47K 13/24* (2013.01); *A47C 7/62* (2013.01); *A47C 15/004* (2013.01); *A47K 13/005* (2013.01); *A47K 17/02* (2013.01); *Y10T 29/49826* (2015.01)

(58) Field of Classification Search

CPC ..... A47K 13/24; A47K 13/005

USPC ..... 4/234, 480

See application file for complete search history.

(56) References Cited

U.S. PATENT DOCUMENTS

| | | | |
|---|---|---|---|
| 905,496 | A | 12/1908 | Cameron |
| 1,781,938 | A | 11/1930 | Zundel |
| 2,517,755 | A | 8/1950 | Yumoto |
| 2,582,321 | A | 1/1952 | Farrell |

(Continued)

FOREIGN PATENT DOCUMENTS

| | | |
|---|---|---|
| CN | 202875210 | 4/2013 |
| DE | 20209191 | 10/2002 |

(Continued)

OTHER PUBLICATIONS

"Throne", Retrieved from the Internet on Nov. 1, 2013 <URL: http://www.core77.com/blog/business/idealicious_sounds_cool_lets_see_how_well_they_actually_do_20887.asp>.

(Continued)

*Primary Examiner* — Huyen Le

(74) *Attorney, Agent, or Firm* — Brooks Acordia IP Law, PC; Douglas N. Larson

(57) ABSTRACT

A chair assembly including a toilet seat, a chair seat lid and a backrest. The toilet seat, the lid and the backrest are connected relative to one another such that they are positionable in alternative chair and toilet-use modes. The lid is behind the generally upright backrest when the assembly is in the toilet-use mode and is on the toilet seat when the assembly is in the chair mode. The assembly can have self-supporting legs whereby it can form a standalone chair remote from the toilet. When in a male urination mode, the toilet seat is lifted and the backrest is in a lifted, generally horizontal position.

27 Claims, 25 Drawing Sheets

(56) References Cited

U.S. PATENT DOCUMENTS

| | | | | | |
|---|---|---|---|---|---|
| 2,607,926 | A | | 8/1952 | De Puy | |
| 3,062,582 | A | * | 11/1962 | Baldwin | A61G 5/08 297/118 |
| 3,716,872 | A | | 2/1973 | Zieman | |
| 3,905,051 | A | | 9/1975 | Gozdziewski | |
| 3,921,235 | A | | 11/1975 | O'Neil | |
| 4,503,571 | A | | 3/1985 | Sidney | |
| 5,163,188 | A | * | 11/1992 | Munroe | A61G 5/1002 297/DIG. 4 |
| 6,006,369 | A | * | 12/1999 | Bly | A47K 11/04 4/236 |
| D421,544 | S | | 3/2000 | Thomas-Scruggs | |
| 6,311,341 | B1 | | 11/2001 | Zwezdaryk | |
| 6,389,612 | B1 | | 5/2002 | Harris | |
| 6,742,195 | B1 | | 6/2004 | Parry | |
| 8,863,321 | B2 | * | 10/2014 | Schottenstein | A47C 7/62 4/234 |
| 2012/0146371 | A1 | | 6/2012 | Cotton | |

FOREIGN PATENT DOCUMENTS

| | | | |
|---|---|---|---|
| DE | 102007028678 | B3 | 10/2008 |
| JP | 11009500 | | 1/1999 |
| JP | 2002-200006 | | 7/2002 |
| JP | 2009-247636 | | 4/2008 |
| JP | 3160192 | | 6/2010 |

OTHER PUBLICATIONS

"Throne", Retrieved from the Internet on Nov. 14, 2013 <URL: http://www.ideacious.com/details2000000028.htm>.

* cited by examiner 150
140
530
540
550
270
520
570

TOILET CHAIR ASSEMBLY

CROSS-REFERENCE TO RELATED APPLICATIONS

This application is a continuation of copending application Ser. No. 14/080,791, filed Nov. 14, 2013, which issued as U.S. Pat. No. 8,863,321, and which claims the benefit of provisional application Ser. No. 61/726,479, filed Nov. 14, 2012, and whose entire contents are hereby incorporated by reference.

BACKGROUND

With the lid of a toilet in a down position over/on the toilet seat, a person can sit on the lid supported by the toilet bowl. However, this seating arrangement is not attractive, comfortable or flexible in its use.

SUMMARY

According to an aspect of the disclosure provided herein is an assembly that can be easily converted by a user between a non-bathroom (remote) chair mode (suitable for use in a living room or office, for example) and a bathroom seating mode where it can be easily converted to a toilet-use mode over a toilet bowl or the like.

According to one aspect of the disclosure provided herein is an assembly that includes a toilet seat, a chair seat lid and a backrest. The toilet seat, the lid and the backrest are connected relative to one another such that they are positionable in alternative standard seat, toilet seat, and toilet seat-up positions. The backrest is in front of the lid when the assembly is in the toilet seat position (toilet-use mode), and the lid is on the toilet seat when the assembly is in the standard seat position.

According to another aspect of the disclosure provided herein is a chair assembly having an alternative toilet-use mode wherein the backrest can be flipped up and then back down to conceal a raised toilet lid and also position the underside (bowl-facing side) of the toilet lid out of contact with the user.

According to a further aspect of the disclosure provided herein is a toilet chair positionable over a toilet wherein the chair has a toilet seat and a pull-out footrest for a user sitting on the toilet seat. When the footrest is in a stored position it is generally flush with the surrounding skirt of the chair and thus practically invisible.

According to a still further aspect of the disclosure provided herein is a chair assembly positionable in a toilet-use mode with the top surface of its toilet seat exposed and the toilet seat positioned over a toilet bowl and a chair mode distant from the toilet and with its toilet seat separated from the chair. The separated toilet seat can be attached to an operative position on the toilet.

According to another aspect of the disclosure provided herein is a chair assembly that is fully supported by legs thereof such that the chair assembly can be positioned in a usable toilet seat position over a toilet and then moved away from the toilet to form a standalone chair with a seat, which is not the toilet seat, forming the sitting support surface. As an example, the chair can have casters at the end of its legs so that the chair can be easily rolled between a position over a toilet and a position remote from the toilet. The casters can be locked when the chair assembly is in a desired position to prevent it from rolling.

According to yet another aspect of the disclosure provided herein is a chair assembly that forms a chair having a chair seat, a toilet seat, a backrest and arms on opposite sides of the chair seat wherein the arms are adjustable in the x, y and z directions to allow a user to personally customize the positions of the arms for chair mode and for toilet-use mode.

According to still yet another aspect of the disclosure provided herein is a method of reconfiguring a chair assembly herein between a chair mode and a toilet seat mode including raising a backrest to a flipped up position, pivoting a chair seat lid off of a toilet seat lid over a toilet to a raised position behind the flipped-up backrest and lowering the backrest to a flipped-down position so that the chair seat lid is positioned behind the backrest and the backrest is positioned behind a user's back when sitting on the exposed toilet seat.

According to a still further aspect of the disclosure provided herein is a frame (or chair) assembly including a frame, a backrest pivotally attached to an upper location of the frame, a chair seat lid pivotally attached to a lower location, a toilet seat pivotally attached to a lower location and the chair seat lid being pivotal between alternative positions on the toilet seat and behind the backrest. The toilet seat can be detached from the lower location on the frame and pivotally attached to a toilet bowl. For example, the lid and the toilet seat can be pivotally attached to a bottom bar of the frame and the backrest can be pivotally attached with a hinge to a top bar of the frame. An alternative is for the top and bottom bars to be attached to the unit via their own separate supports instead of being attached to one another via the vertical bars of a shared frame.

According another aspect of the present disclosure provided herein is a chair assembly having a backrest, a chair seat lid, a toilet seat and a skirt. The chair assembly is positionable relative to a toilet such that the toilet seat is positionable over the toilet bowl and the skirt surrounds a forward portion of the toilet bowl. The chair assembly includes a footrest positionable in a non-use hidden position and an alternative extended use position. When in the non-use hidden position a bottom face of the footrest forms a portion of the skirt.

According to a further aspect of the present disclosure provided herein is a chair assembly having a seat and a footrest, which is positionable in a non-use position and an alternative extended use position. Movement of the footrest from the hidden position to the use position includes moving the footrest through mechanical means outwardly away from the seat, then pivot (rotate) ninety degrees forwardly and then lift upwardly.

According to a still further aspect of the present disclosure provided herein is a chair assembly having a backrest, a chair seat lid, a toilet seat and a headrest. The chair assembly is positionable relative to a toilet such that the toilet seat is disposed over the toilet bowl. The backrest is curved as is its supporting frame such that the top of the frame is above the tank of the toilet, which allows for the backrest to have additional curvature without impeding on the availability of the surface area of the chair seat lid or the toilet seat. If the backrest has a large convex curvature (lumbar support, for example), it may extend forward far enough that, without such a curvature in the frame, it would obstruct a seated user's access to the full seating surface area of the lid or the toilet seat. The curved frame support allows for the backrest to attach further back so the foremost point of the backrest (the user-facing curvature) does not extend forward so as to be on top of or over the lid or seat area.

According to another definition of the present disclosure provided herein is a chair assembly having a chair mode and an alternative toilet seat mode. The chair assembly when positioned over a toilet and in the chair mode makes the bathroom space conducive to non-toilet-specific activities, such as resting, computer work and reading.

According to a further definition of the present disclosure provided herein is a chair assembly having a toilet seat, a chair seat lid, a backrest and one or more telescoping legs with bottom lockable casters. The chair assembly can be wheeled into position over a toilet bowl and lowered into place via its telescoping legs.

According to yet another definition of the present disclosure provided herein is a chair assembly that includes: a rectangular, frame-like support; a backrest attached to a top bar of the support by a top friction hinge; a chair seat lid attached to a bottom bar of the support by a bottom friction hinge; a toilet seat attached to the bottom bar at either side of the bottom friction hinge by a hinge apparatus with a small opening that allows the toilet seat to be hooked or clipped onto the bottom bar, and also detached from the bar and attached via a similar fixture to the toilet hardware.

According to yet a still further definition of the present disclosure provided herein is a chair assembly having a toilet seat and a chair seat lid and operatively positionable over a bowl of a toilet without a toilet seat. The chair assembly is movable from the operative position to a location remote from toilet. The toilet seat is removable from the chair assembly and operatively attachable to the toilet itself. The chair assembly when in the remote location, the toilet seat removed and the lid in a down position forms an adjustable, attractive and comfortable chair, which in addition to the backrest can have arms and so forth.

Further objects and advantages of the disclosure will become apparent from a consideration of the drawings and ensuing description.

DETAILED DESCRIPTION

Figure 1:
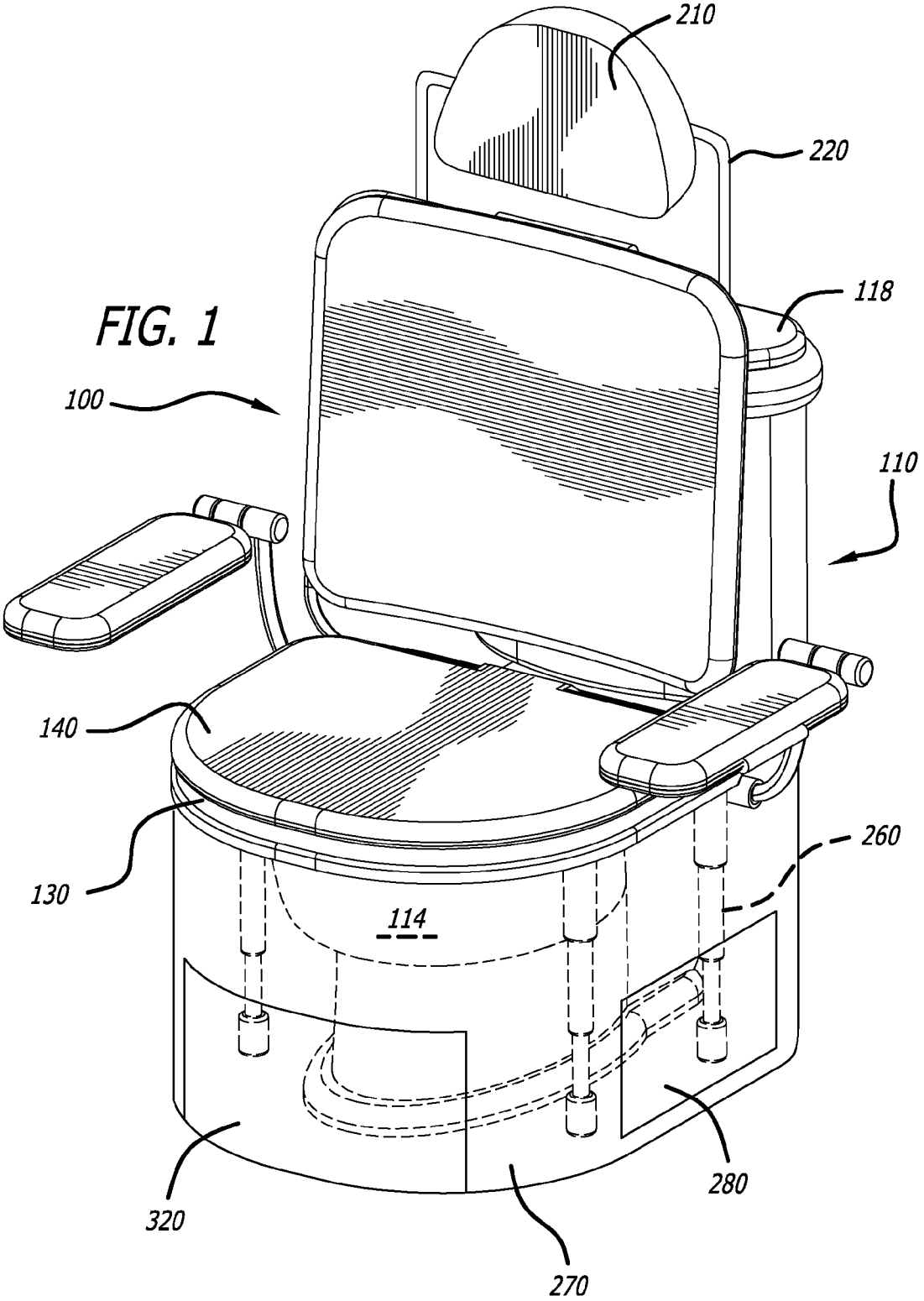
FIG. 1 is a front perspective view of a chair assembly of the present disclosure in position over a toilet and in a chair mode.

A chair assembly of the present disclosure is illustrated generally at 100 in FIG. 1 and shown in position over a toilet as depicted generally at 110 and including a bowl 114 and a tank 118. The chair assembly 100 is illustrated in a bathroom chair mode.

The chair assembly can include a toilet seat 130, a chair seat lid 140, a backrest 150 and a frame 160. The toilet seat 130 and the lid 140 are connected with a hinge 170 at a lower bar 180 of the frame 160, and the backrest 150 is connected with a hinge 190 to an upper bar 200 of the frame. The toilet seat 130 can be made or plastic or porcelain, or cushioned and upholstered in a non-soilable material such as vinyl or leatherette. The lid 140 can have approximate length and width dimensions of nineteen and seventeen inches, respectively. And the backrest 150 can have approximate height and width dimensions of twenty-three inches. The backrest 150 and the lid 140 can be made with a contoured, cushioned surface upholstered in a non-soilable vinyl, rubber or leatherette material. The lid 140 can be a cushioned lid.

Figure 2:
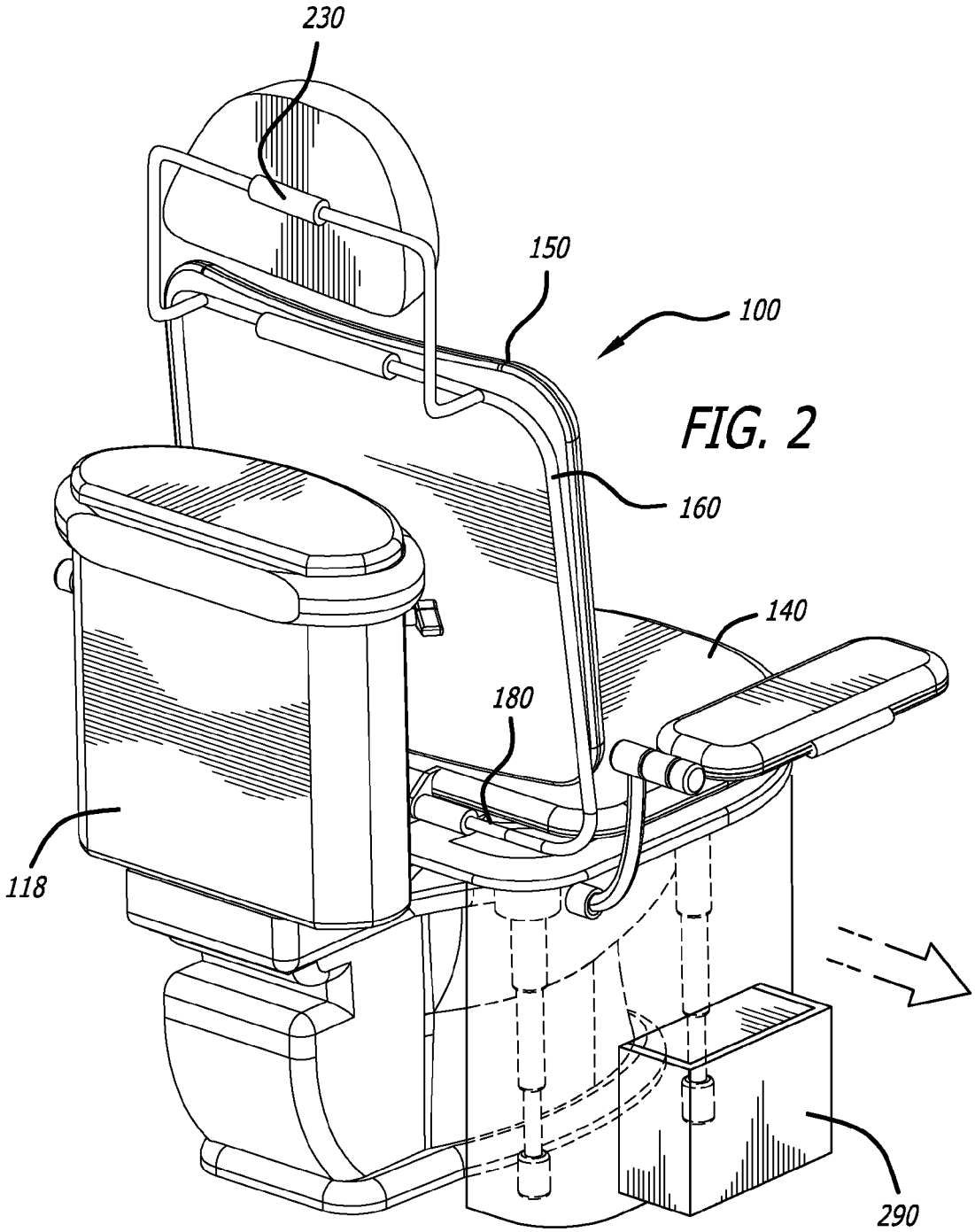
FIG. 2 is a rear perspective view of the chair assembly of FIG. 1 and showing a side storage compartment being pulled out.

A headrest 210 can be attached to an extension 220 of the frame (or the frame) itself and can be pivotable about a hinge 230, as shown for example in FIG. 2.

Figure 17:
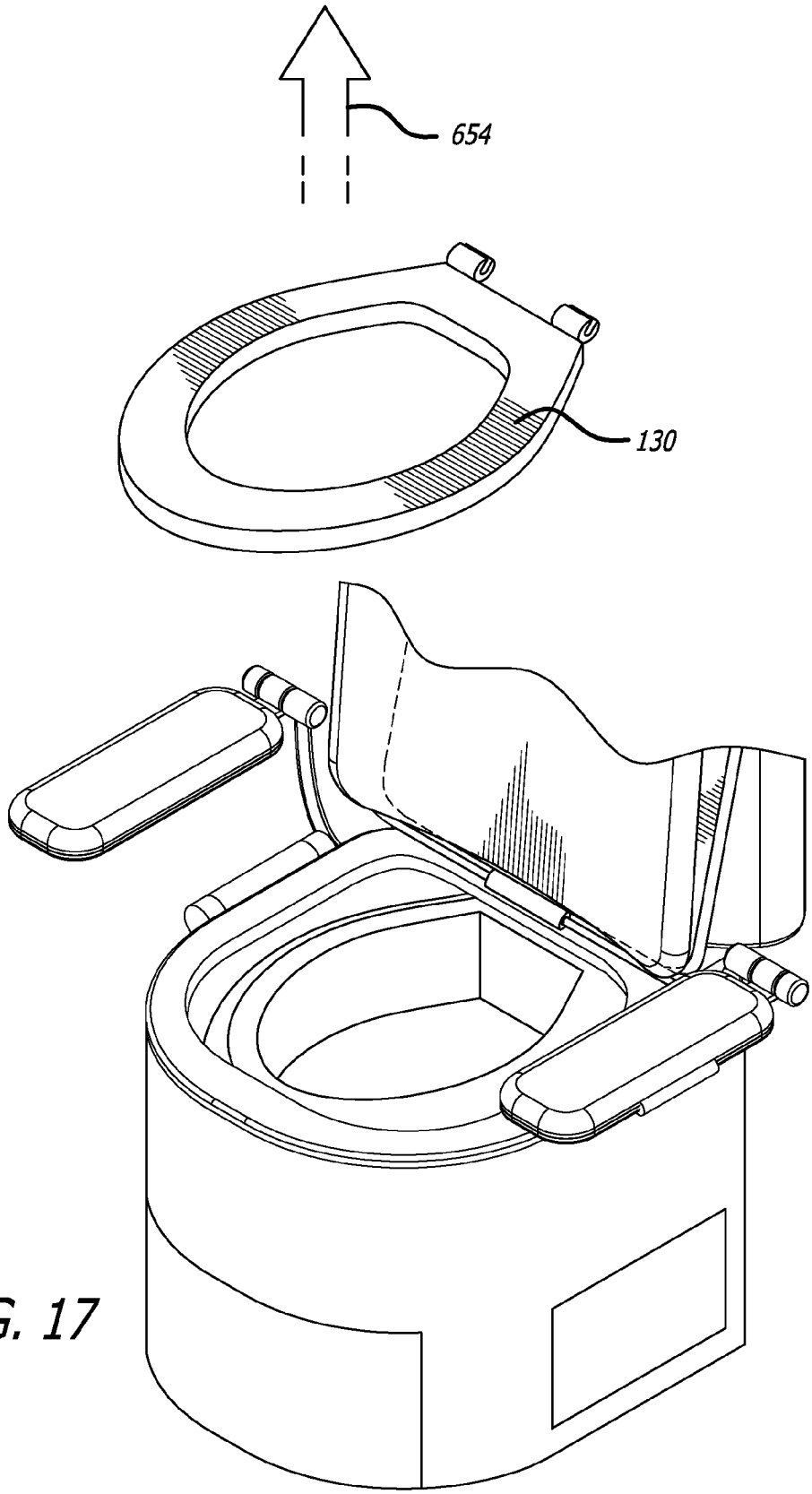
FIG. 17 is a top front perspective view of a portion of the chair assembly of FIG. 16, for example, showing the toilet seat in a removed position from the chair assembly.

The frame 160, in turn, can be mounted via screws and/or rivets to a platform support 240 of the chair assembly. The platform support 240 has a large central opening, as can be seen for example in FIG. 17, over the toilet bowl and under the opening of the toilet seat 130 which is in a toilet-use mode. The frame 160 can be made of metal or plastic as can the platform support. The platform 240 can be supported on the floor and over the toilet 110 by height-adjustable (telescoping) legs 260.

A skirt 270 can depend down from the platform support 240, at least partially encircling the toilet 110 to at least partially hide the toilet. The skirt 270 can be made, for example, of plastic, laminate or sealed wood.

Figure 6:
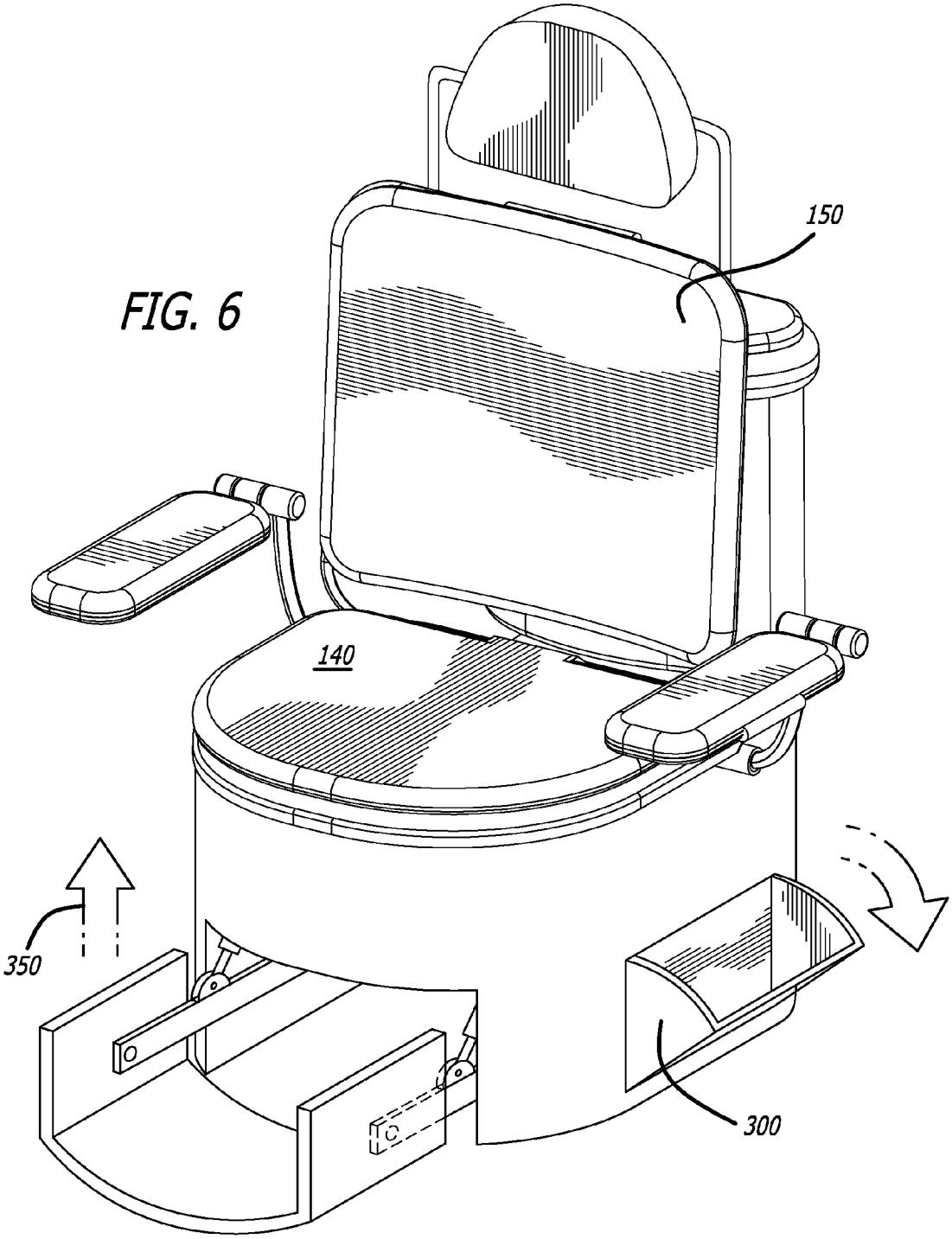
FIG. 6 is a view similar to FIG. 5 showing the footrest in a pivoted (rotated) down position and showing a side storage compartment being moved to an open tilt-out position.
Figure 7:
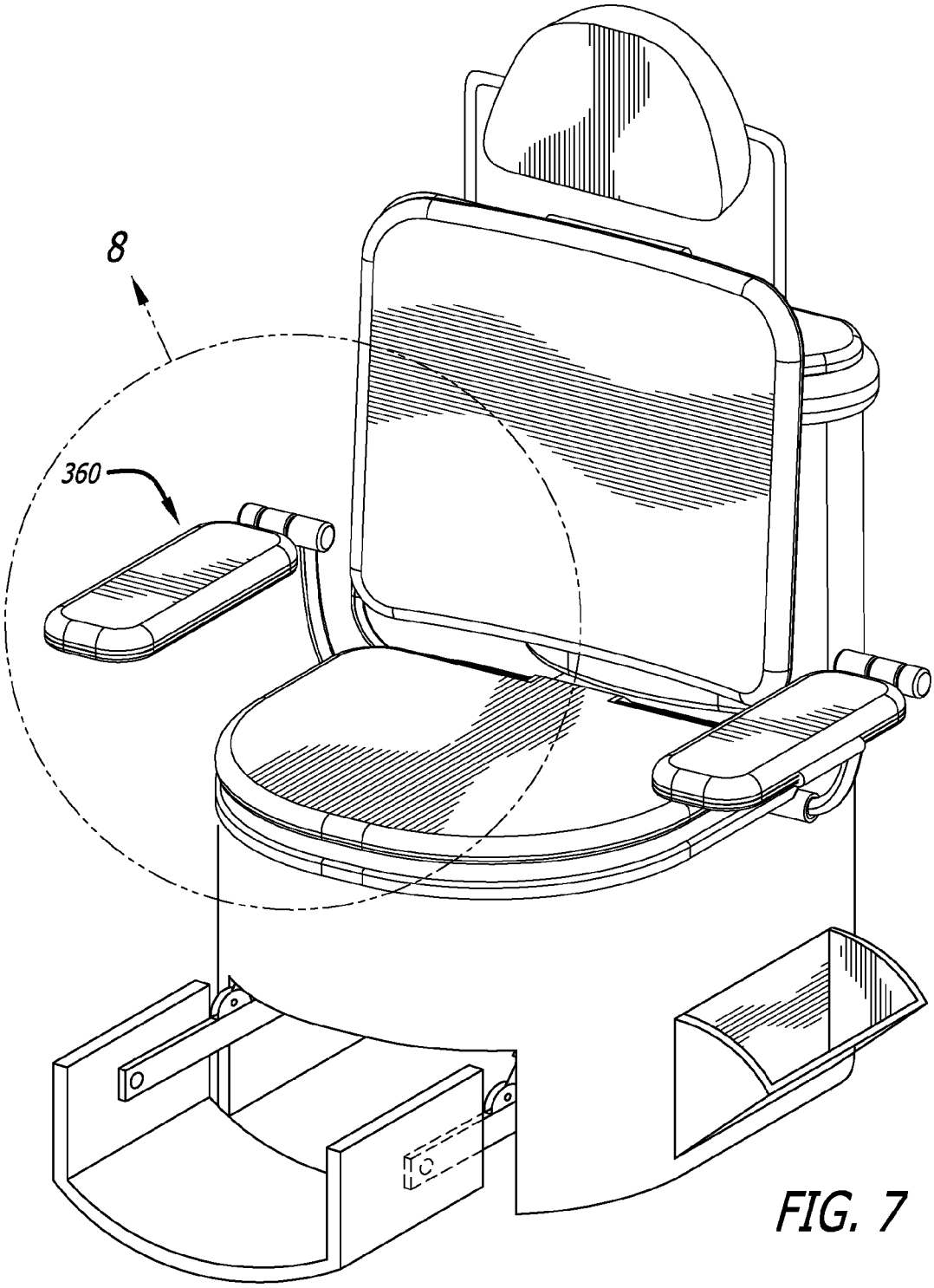
FIG. 7 is a view similar to FIG. 6 showing the footrest in a lifted-up operative position; the footrest can be constructed to be lifted to an even higher operative position, approximately twenty-four inches above the floor.
Figure 21A:
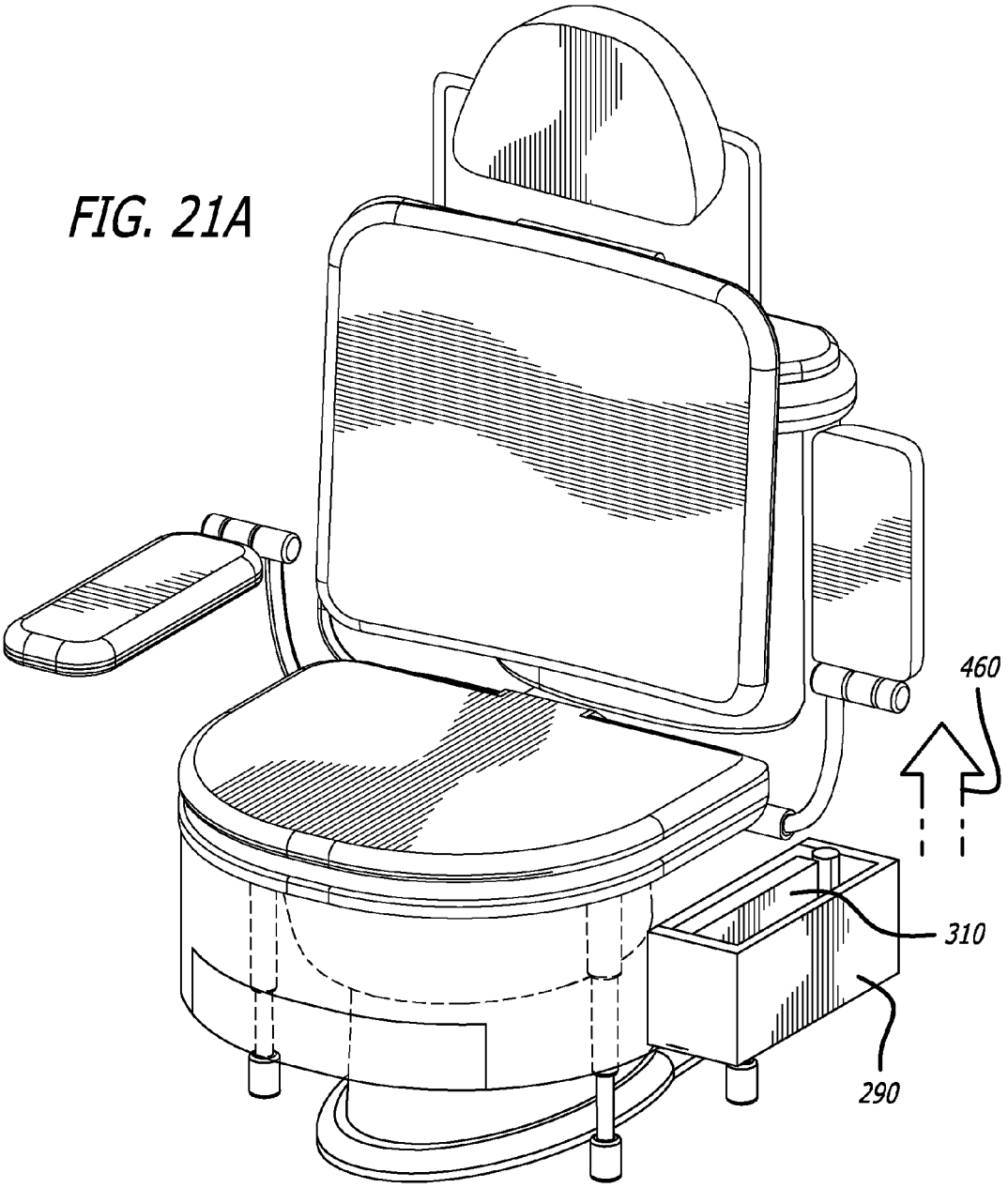
FIG. 21A is a front perspective view of yet another chair assembly of the present disclosure positioned over a toilet and in a chair mode and with the side box pulled out and the adjacent arm in a raised position; the skirt of this assembly is only half-length, not extending to the floor and the housings for the hidden footrest and side compartments are positioned higher on the assembly (closer to the bowl) than those depicted in FIG. 1, for example.
Figure 21B:
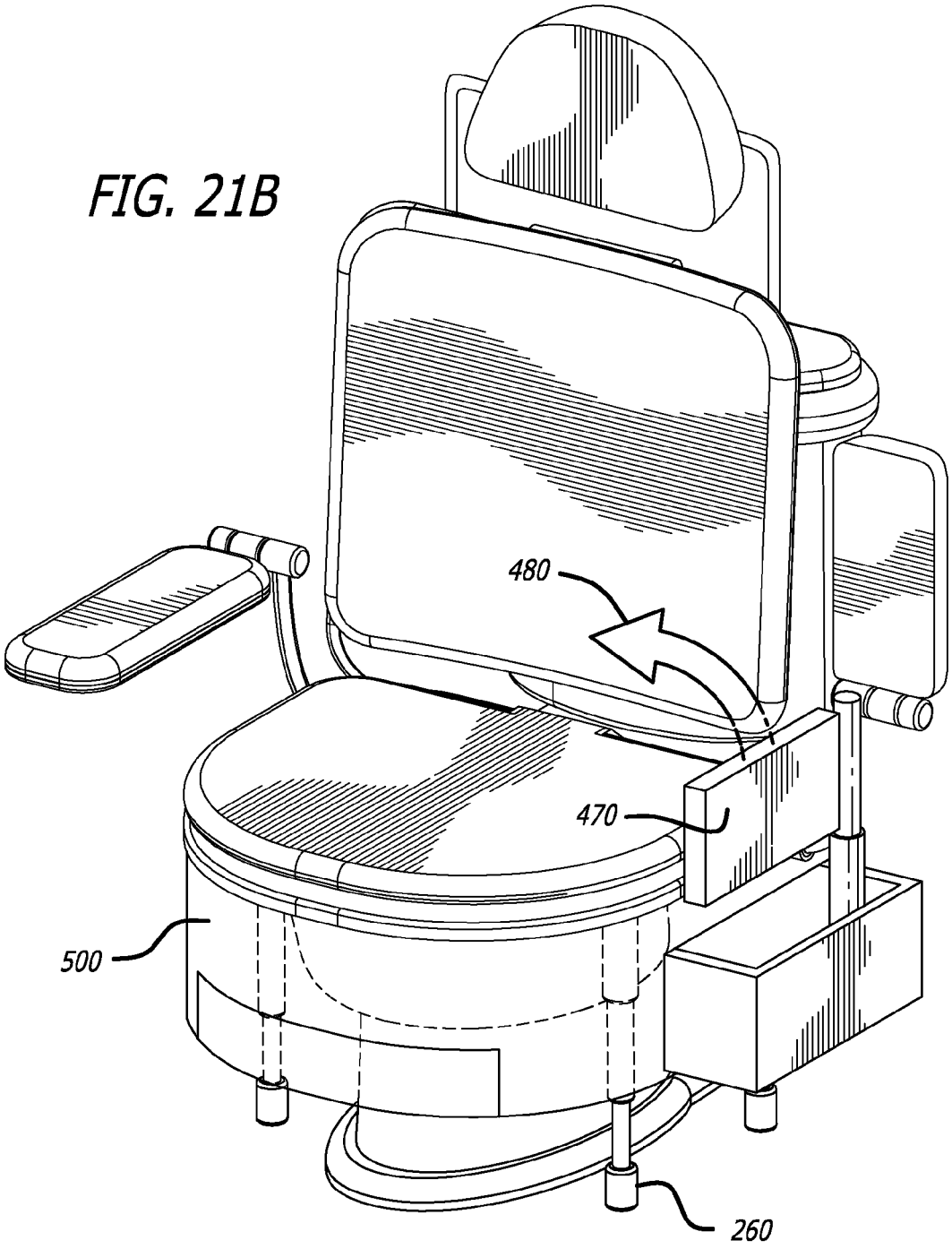
FIG. 21B is a view similar to that of FIG. 21B showing the tray being lifted out of the box.
Figure 21C:
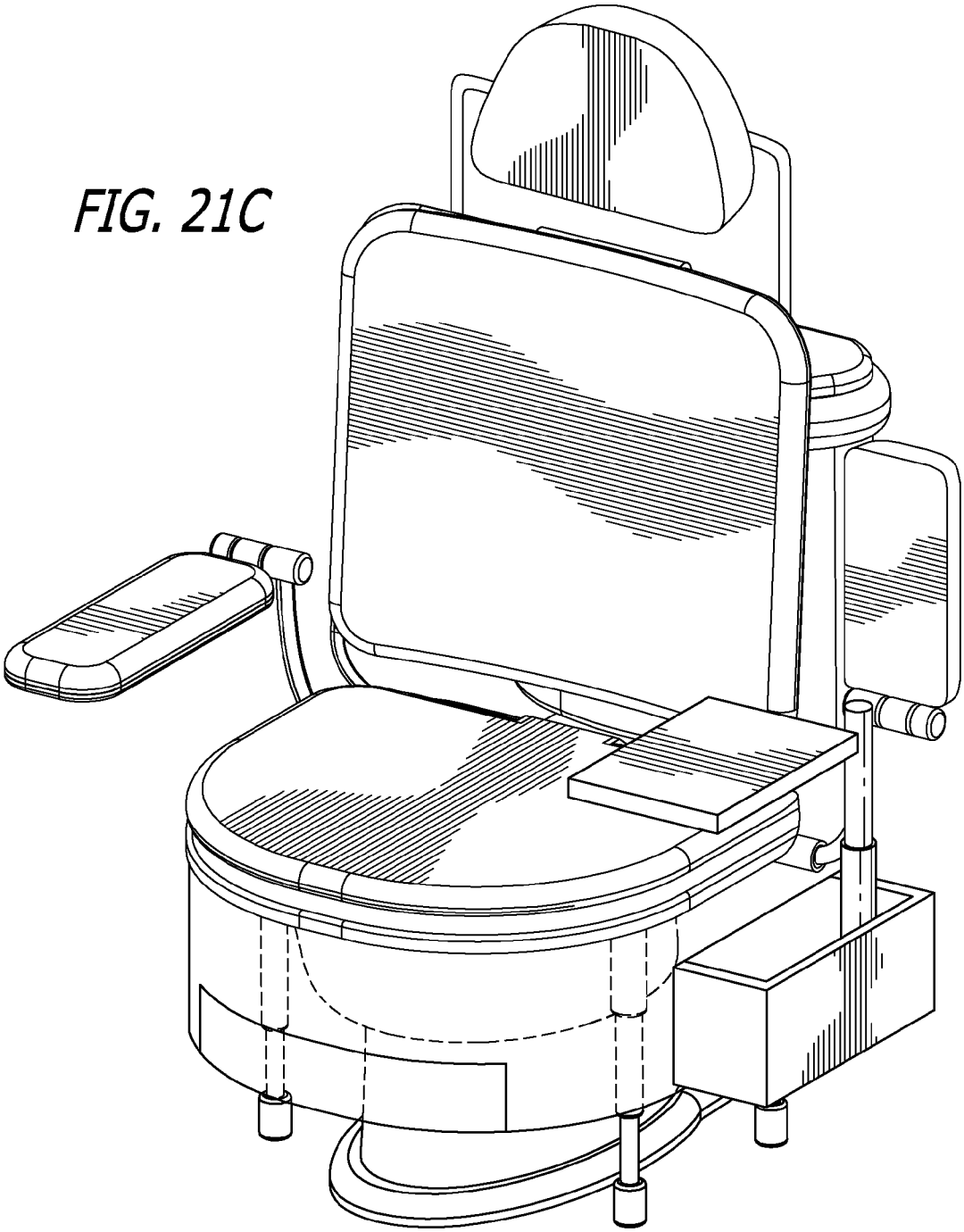
FIG. 21C is a view similar to that of FIG. 21C showing the tray in an operative horizontal position over the chair seat lid.

Side portions 280 of the skirt can form outward surfaces of side compartments. The side compartment can be a box or sliding drawer 290 such as shown in FIGS. 2 and 21A. Alternatively, the side compartment can be a tilt-down compartment 300 such as shown in FIGS. 6 and 7. The side compartments can be used to hold reading material, toilet tissue or reading glasses, for example, or even a fold-out tray 310 as depicted in FIGS. 21A-21C. When closed, the side portions 280 are flush with the surrounding skirt 270 and thereby are practically hidden. The side compartments can include notches or handles to assist in opening and closing.

Figure 5:
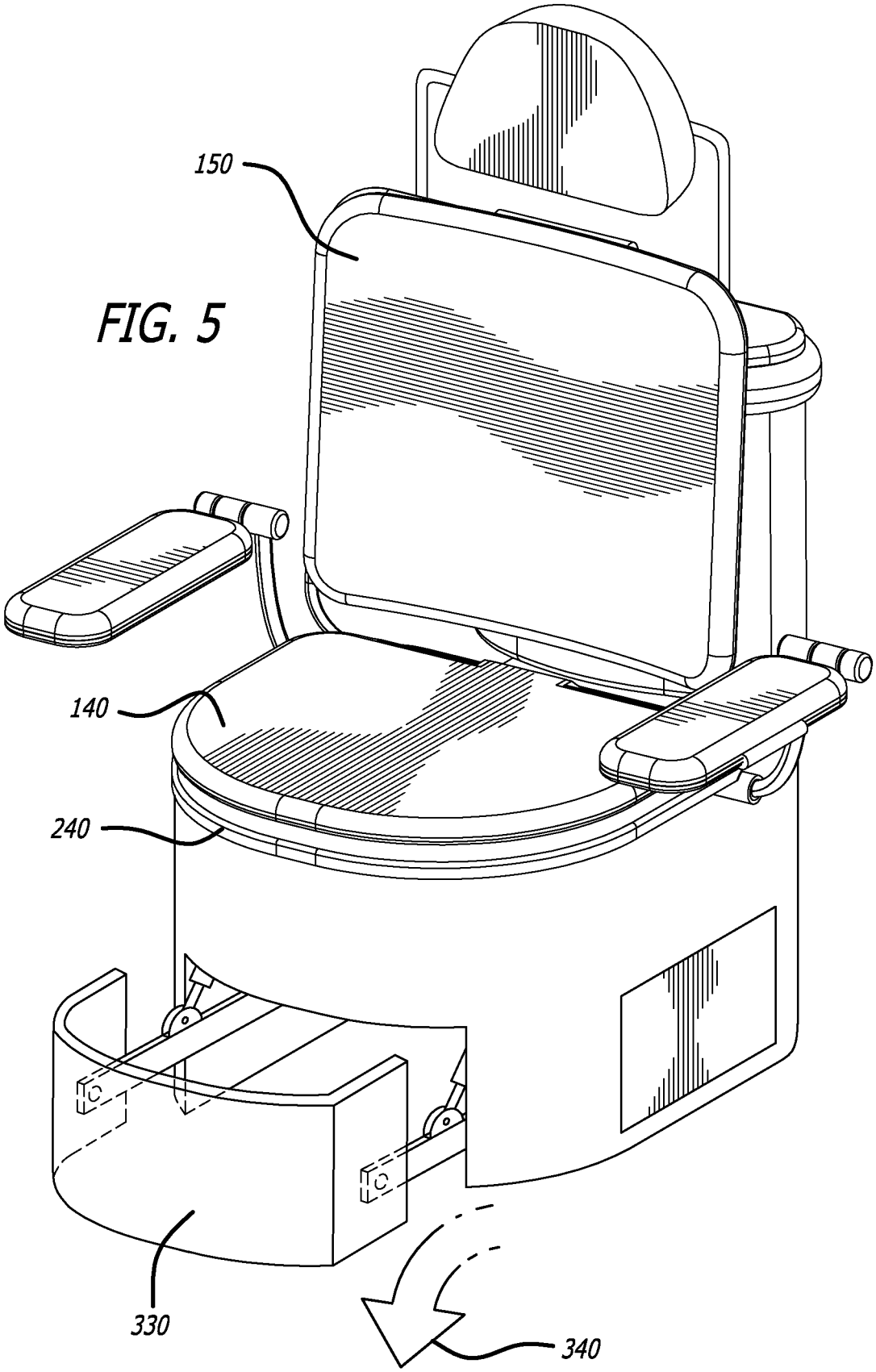
FIG. 5 is a view similar to FIG. 1 showing the footrest being moved to a pulled-out position.

A front portion 320 of the skirt can form an outer surface of a footrest 330, as can be understood from FIG. 1, To position the footrest 330 in an operative position, it is pulled out (as shown in FIG. 5), rotated ninety degrees (as shown by the arrow 340 in FIG. 5 and the position of FIG. 6) and then lifted up (as shown by the arrow 350 of FIG. 6 and the position of FIG. 7). The movement can be manually along tracks and by pivots, or it can be done mechanically such as by actuation by a lever or by an electrical motor. The footrest can be positioned even higher than depicted in FIG. 7, such as by the embodiment of FIG. 21A where the footrest when in an operative position can be about twenty-four inches above the floor. Positioning the footrest a distance above the floor and when the chair assembly is in a toilet-use mode assists a user sitting on the toilet seat 130 by raising the user's feet so as to allow for posture more conducive to defecation.

Also attached to and supported by the platform 240 can be left and right chair arms 360 having armrests 370 and elongate connector arms 380. The arms, or more particularly the armrests 370, are repositionable by the user as can be understood from FIGS. 9A, 9B and 9C. Referring thereto it can be seen that the connector arms 380 can be mounted with a ball joint socket 390 in the platform, thereby allowing different angles of rotation, as shown by the arrow 394 in FIG. 9C. The connector arm 380 can also having a telescope construction, allowing it to be shortened and lengthened as can be understood by the arrow 400 in FIG. 9B. The repositioning of the arm 360 allows the user to adjust the armrest 370 as may be needed for his physique and/or for his desires and/or to position the armrest out of the way such as for accessing the fold-up tray 310 or the side compartment 290, 300.

Figure 8:
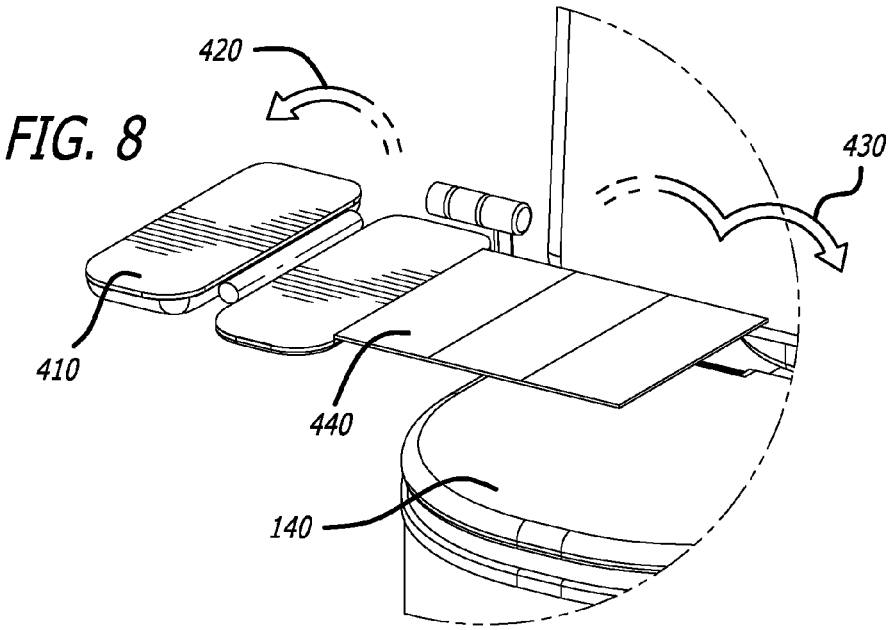
FIG. 8 is a view taken on circle 8 of FIG. 7 and showing the arm in a tray folded out position.

The armrest 370 can have a flip-out construction, allowing a top panel 410 to be rotated outwardly as shown by arrow 420 in FIG. 8. And the arrow 430 in FIG. 8 shows a tray foldout construction 440 to extend over the lap of a user sitting on the lid 140.

The alternative or supplemental tray 310 can be provided as shown in FIGS. 21A-C. Referring thereto, the compartment is pulled out, the tray 310 is (manually) lifted up as shown by arrow 460 in FIG. 21A to the lifted-up position of FIG. 21B. The tray portion 470 is then pulled over as shown by arrow 480 in FIG. 21B to the operative position of FIG. 21C where it is at the side of a user sitting on the lid. The user can then return the tray to its stored position using a reverse movement sequence.

Still referring to FIGS. 21A-C, the skirt 500 is a half-length skirt, which in contrast to the full-length skirt 270 of FIG. 1, for example, provides easier access to the height-adjustable legs 260, and provides for a more pleasing aesthetic appearance when on toilets of generally any height.

Figure 3:
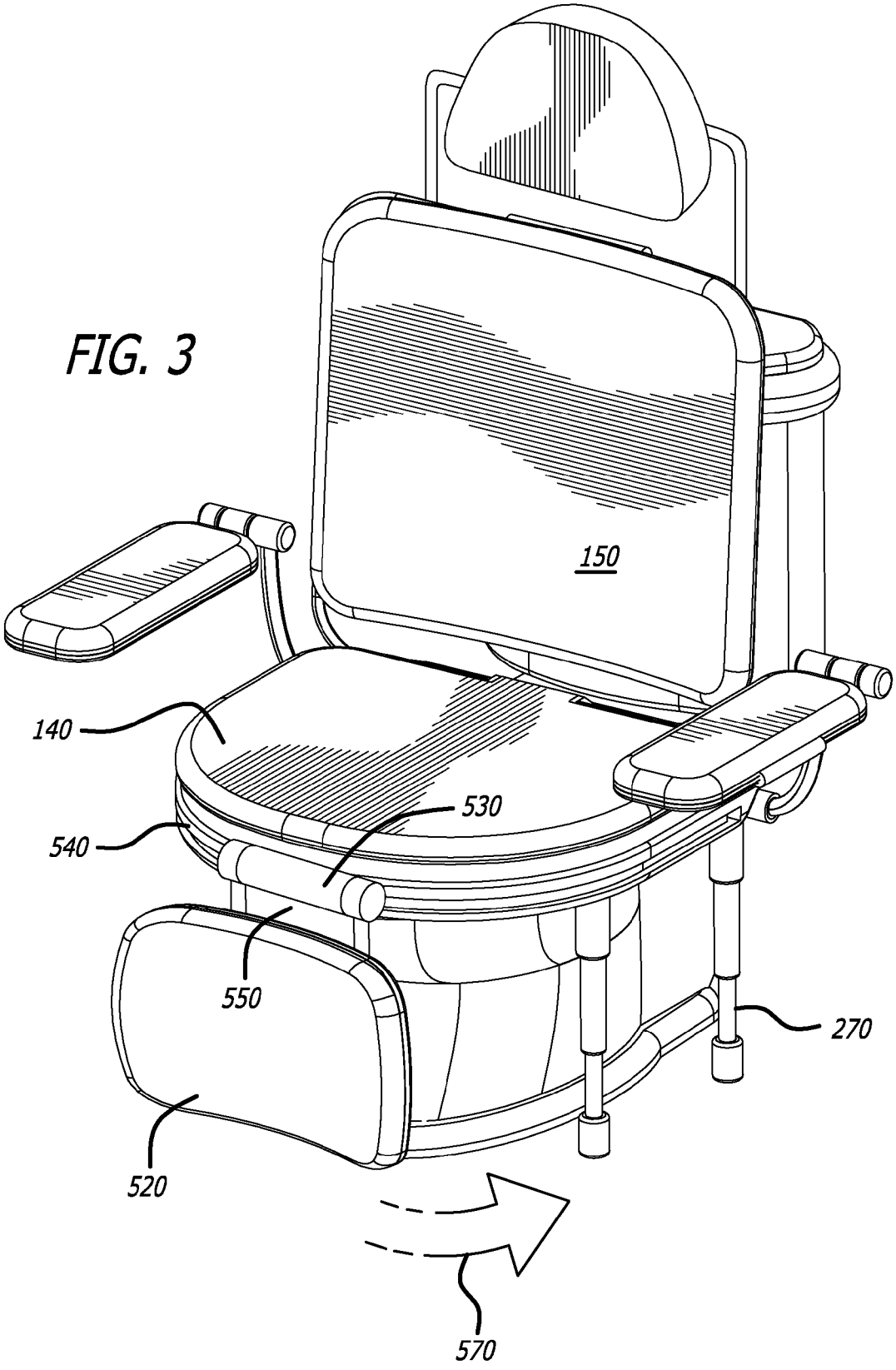
FIG. 3 is a front perspective view of another chair assembly of the present disclosure in position over a toilet and in a chair mode; the chair assembly not having a skirt.
Figure 4:
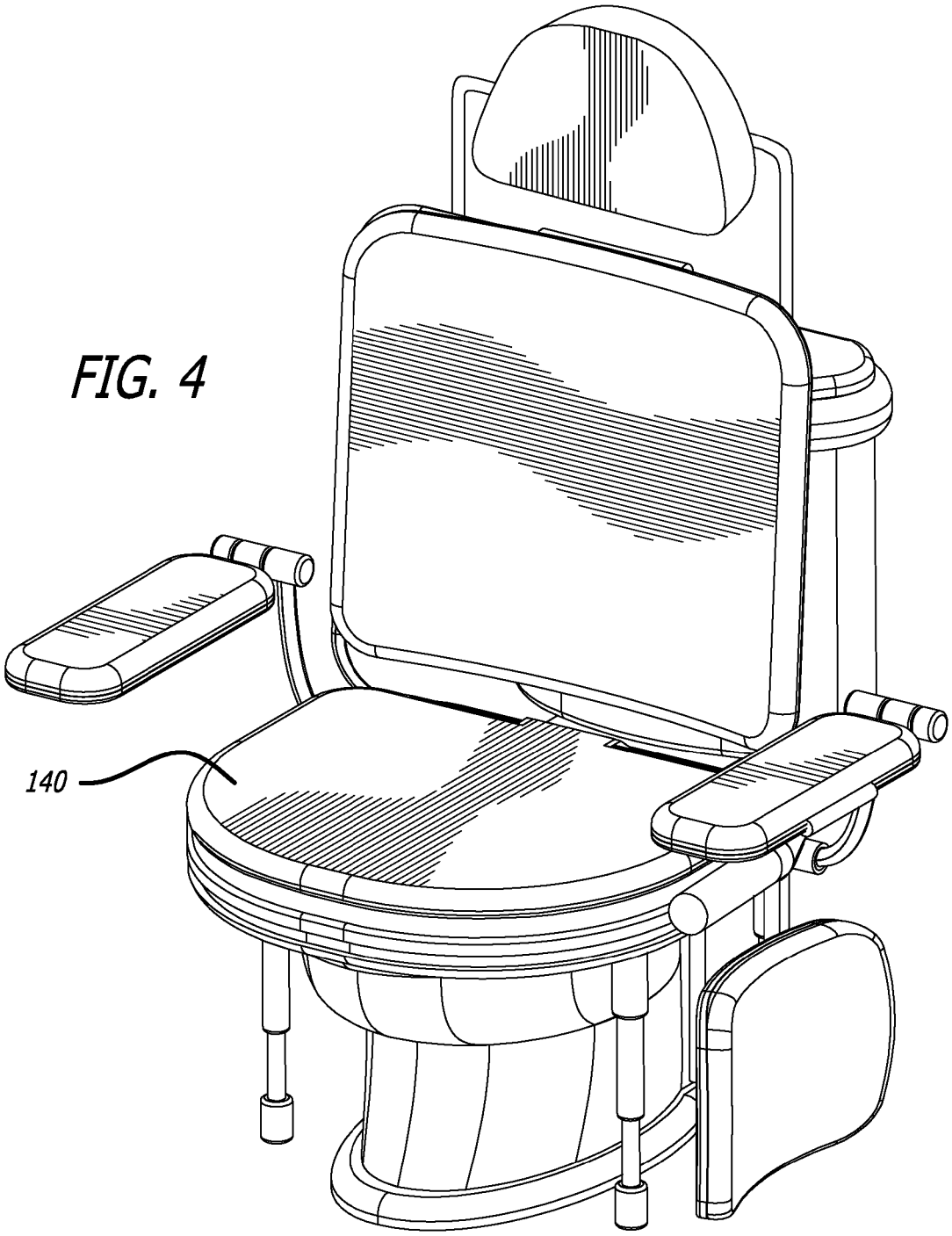
FIG. 4 is a view similar to FIG. 3 but showing the footrest moved via a curved track to an alternative out-of-the-way position.

The chair assembly 540 can be provided with no skirt as shown in FIGS. 3 and 4. The embodiment of these figures also includes a different footrest construction 520, which includes a first friction hinge 530, attached to a track 540 along the edge of the platform 240, and via a support bar 550 to a second friction hinge 560 on the footrest surface. The first hinge 530 slides in a groove along and around the edge of the platform as shown by the arrow 570 in FIG. 3 and between the front position in FIG. 3 and the out-of-the-way position in FIG. 4. When in the forward position it can be lifted upwards about the pivot axis of the friction hinge attached to the footrest surface to a desired operative raised position and releasably held in place by friction or by notches.

The different relative positions of the lid 140, the backrest 150 and the toilet seat 130 to define different uses or modes of the chair assembly will now be described. With the toilet seat 130 down, the lid 140 down on the seat and the backrest 150 in an upright position, the assembly is in a chair mode. This is shown, for example in FIGS. 1, 3, 11 and 21A. When the assembly is positioned over a toilet 110, the chair mode can be referred to as a toilet chair mode; and when the assembly is remote from the toilet, the chair mode can be referred to as a toilet-remote chair mode.

Figure 11:
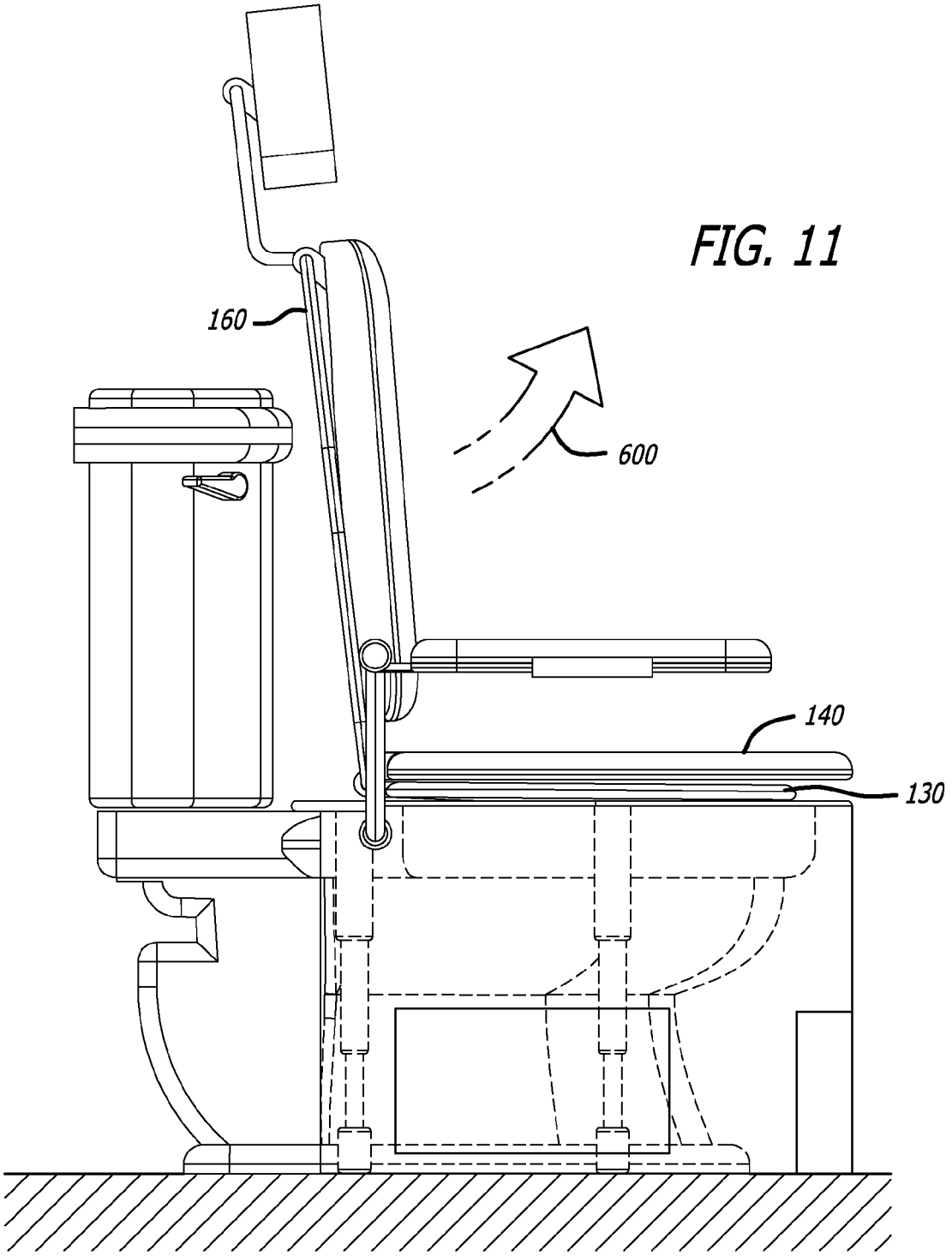
FIG. 11 is a view similar to FIG. 10 showing the chair assembly in a lowered position and the backrest being lifted.
Figure 12:
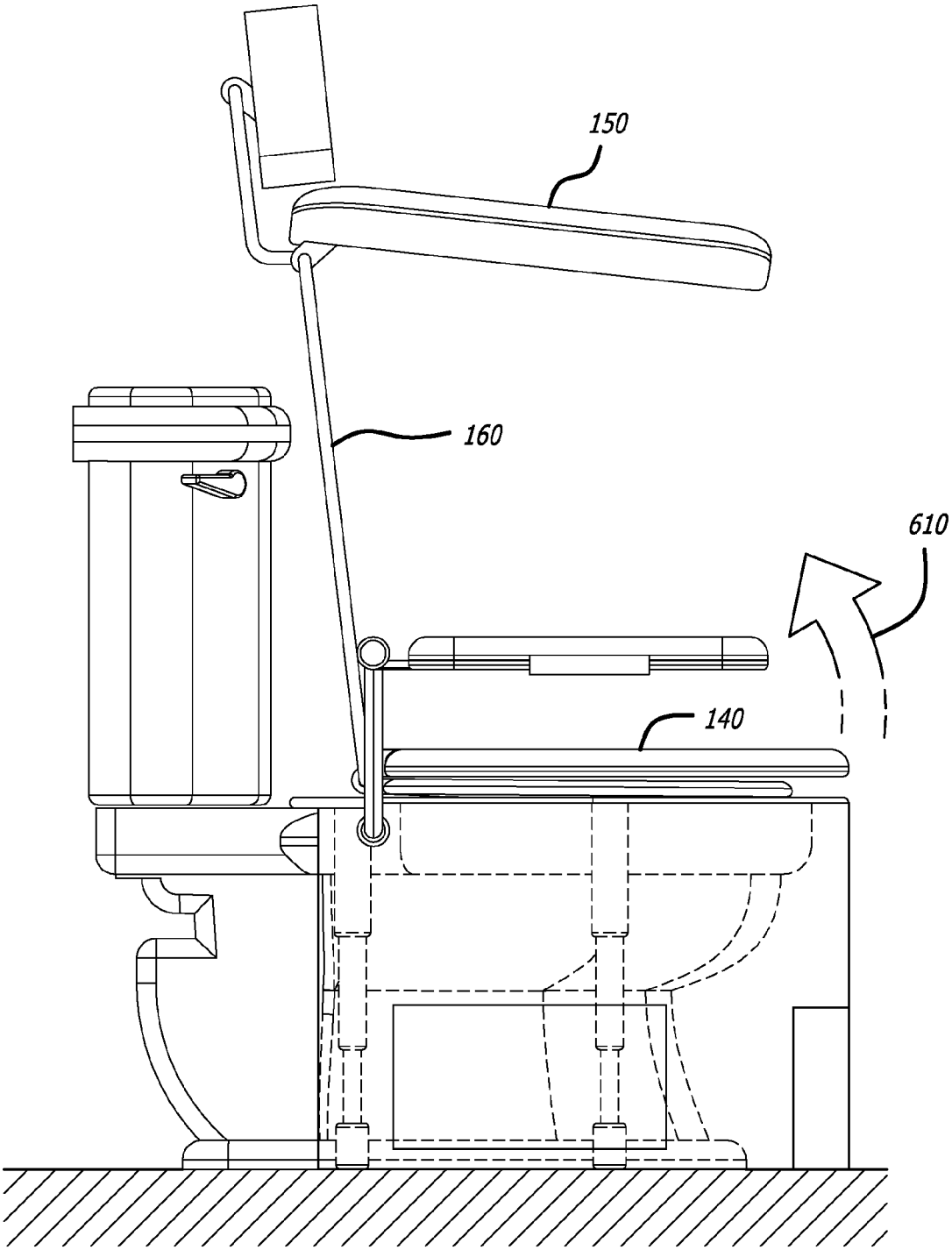
FIG. 12 is a view similar to FIG. 11 showing the backrest in a pivoted-up position and the chair seat lid being lifted.
Figure 13A:
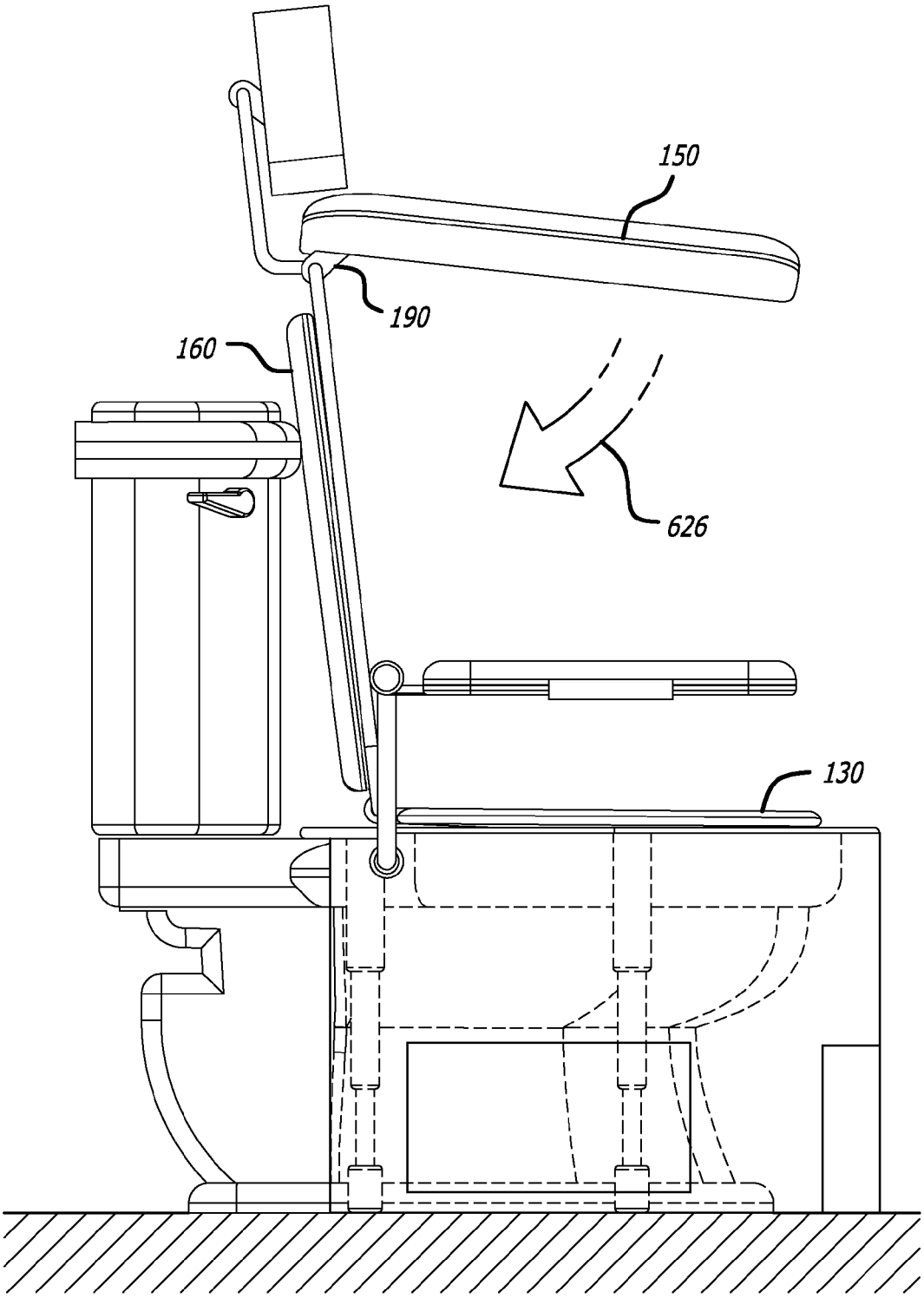
FIG. 13A is a view similar to FIG. 12 showing the chair seat lid in a pivoted-up position and the backrest being lowered so that the chair assembly can be in a toilet-use mode.
Figure 14:
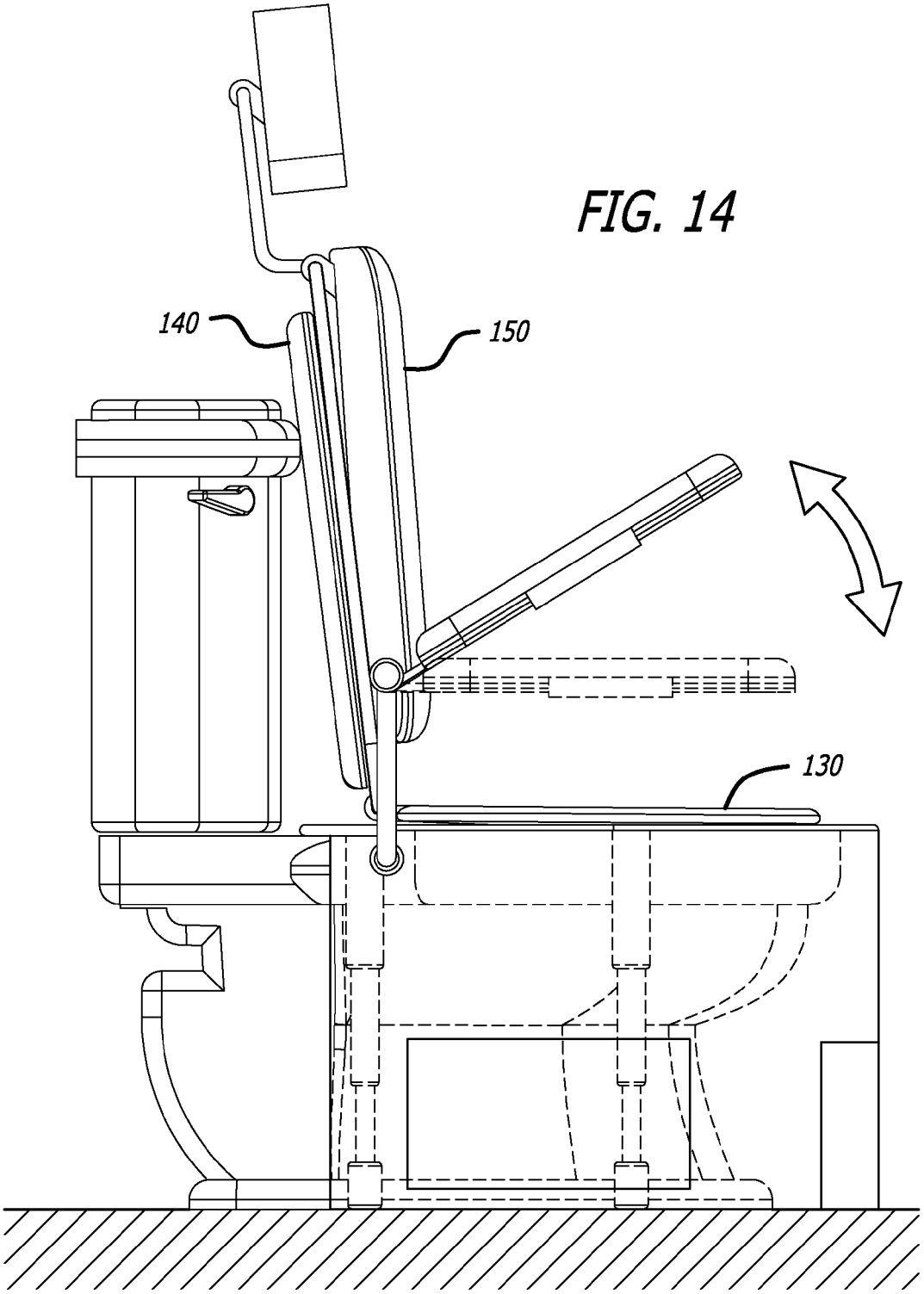
FIG. 14 is a view similar to FIG. 13B showing the backrest in a lowered position, the chair assembly in a toilet seat mode, and the arm being lifted and lowered, for user preference such as he wants the arm rests at an angle or to be completely vertical and thereby out of the way, or to allow for an additional tray table, such as in FIGS. 21A and 21B, to be deployed and used.

To position the chair assembly in a toilet-use mode, the backrest 150 is pivoted up about its hinge as shown by the arrow 600 in FIG. 11 to the raised position in FIG. 12. The lid 140 is then pivoted up, as shown by the arrow 610 in FIG. 12 about its hinge to the raised upright position of FIG. 13A. And the backrest 150 is then lowered as shown by the arrow 620 in FIG. 13A to the lowered position as illustrated in FIG. 14, whereby the toilet seat 130 is in an exposed toilet-use seating position above the toilet bowl.

Figure 13B:
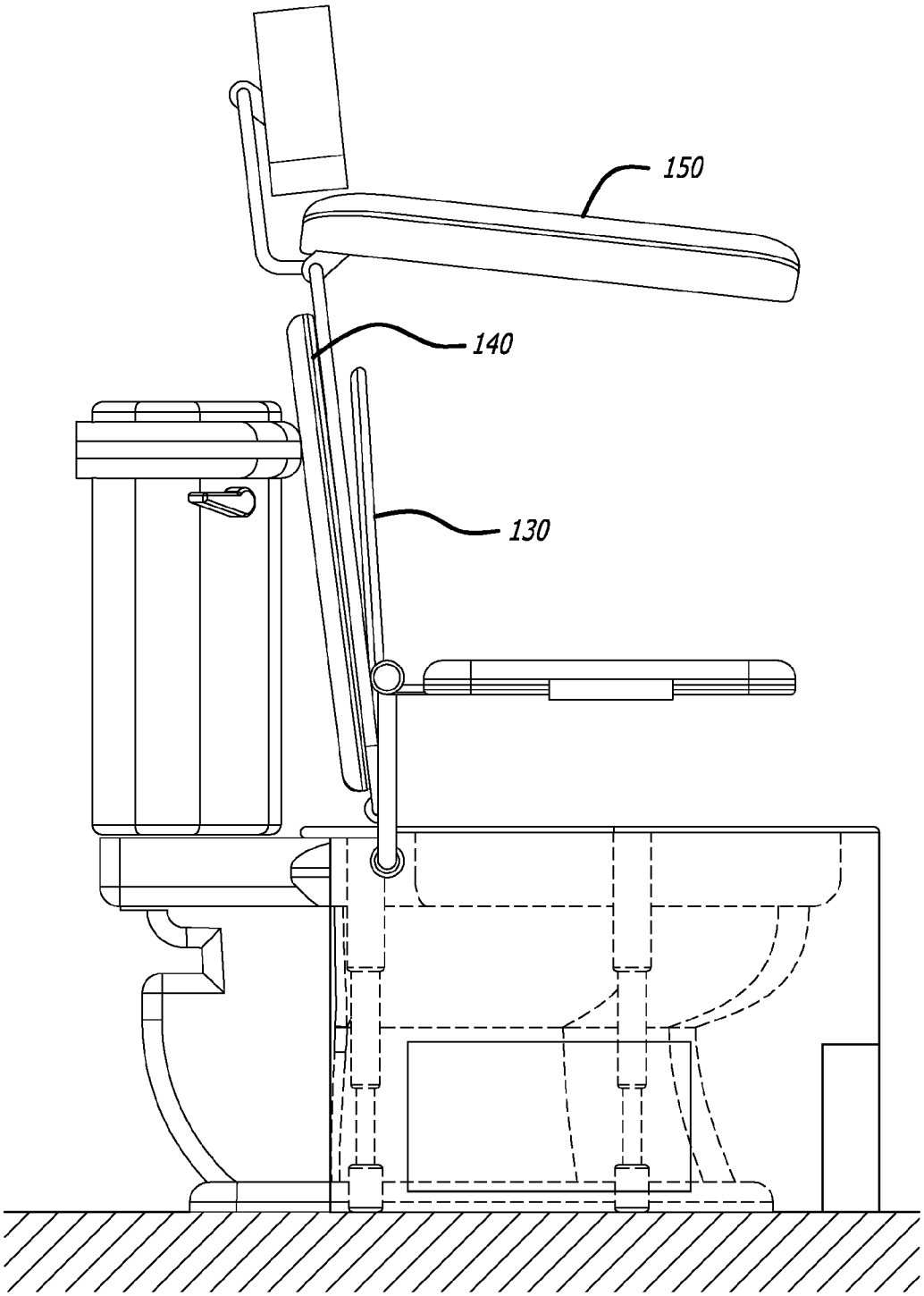
FIG. 13B is a view similar to FIG. 13A showing the toilet seat in a lifted-up position wherein the chair assembly is in a standing male urination position.

The chair assembly is in a standing male urination position as shown in FIG. 13B with the backrest 150 still in the raised position but with the toilet seat 130 in a raised generally upright position with respect to the bowl 114. Continuing to refer to FIG. 13B, the lid 140 is between the toilet tank 118 and the upright toilet seat 130. In contrast, in the toilet-use mode of FIG. 14, the lid 140 is between the tank 114 and the lowered, generally upright backrest 150.

Figure 10:
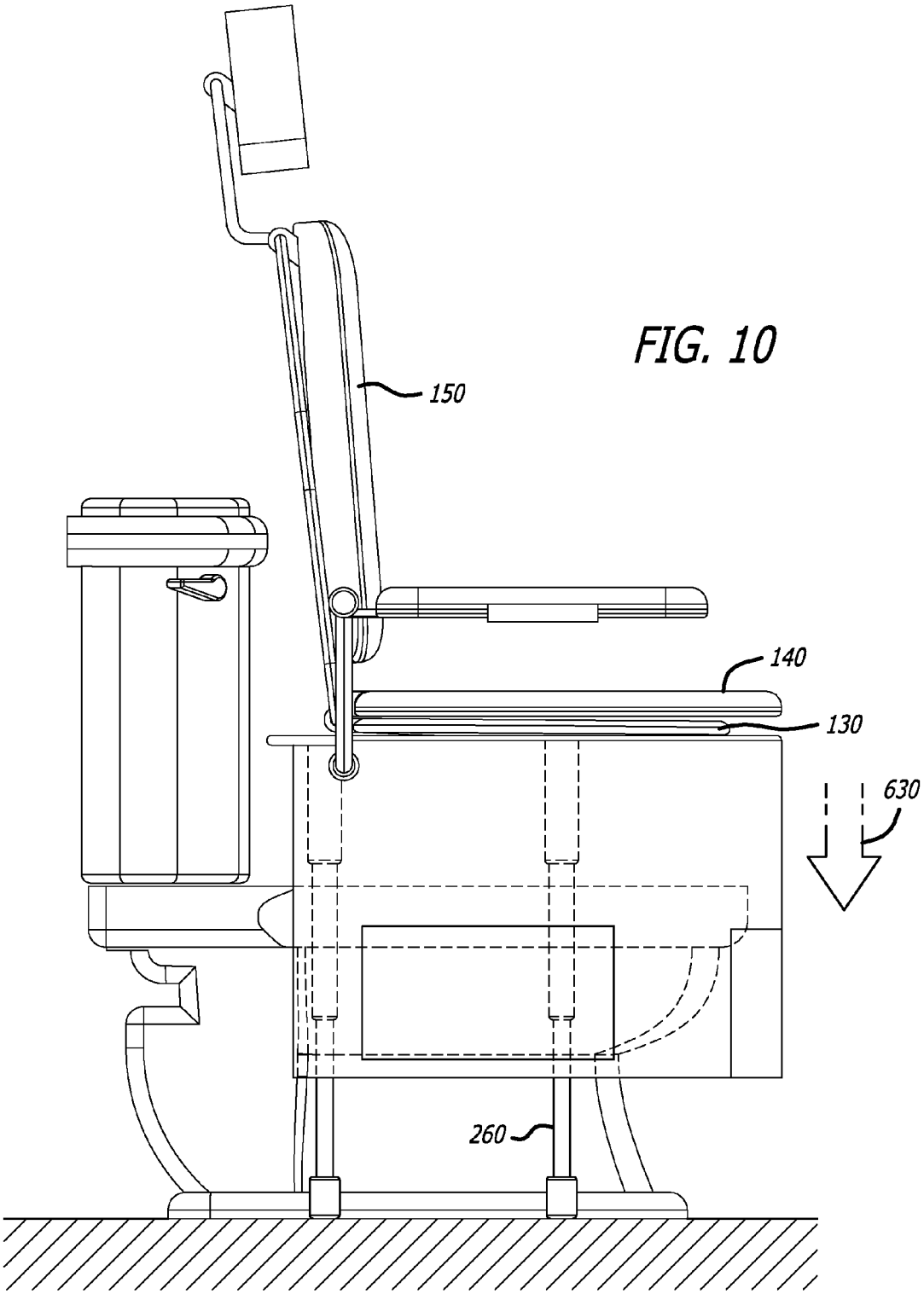
FIG. 10 is a side elevational view of the chair assembly of FIG. 1 showing the chair assembly being lowered into position over a toilet bowl.

The legs 260 can be height-adjustable as mentioned above. This allows for easy and accurate placement of the chair assembly over toilet bowls of generally any height. With the chair assembly in a raised position as illustrated in FIG. 10, the lengths of the legs 260 are shortened as depicted by the arrow 630 in FIG. 10 until the chair assembly is at the proper height as shown in FIG. 11.

Figure 15:
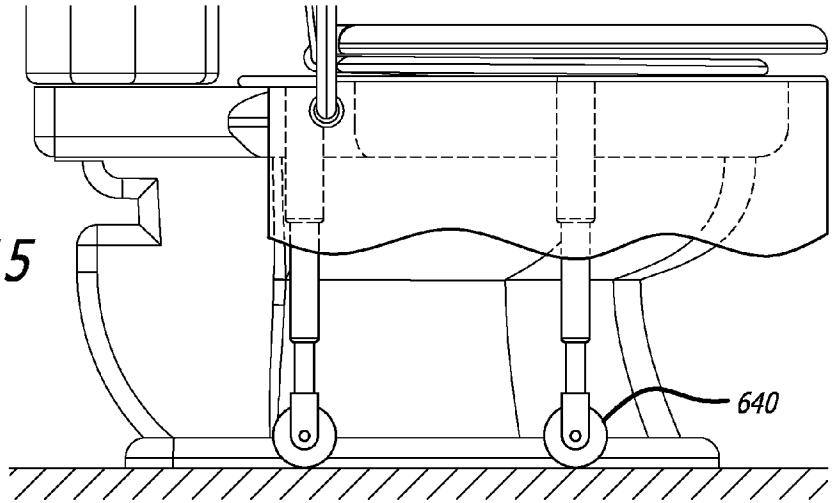
FIG. 15 is a partially broken away, side view of a bottom portion of a chair assembly of the disclosure having (lockable) casters at the ends of the legs and showing the chair assembly in position over a toilet bowl and in a chair mode and with the casters locked.
Figure 16:
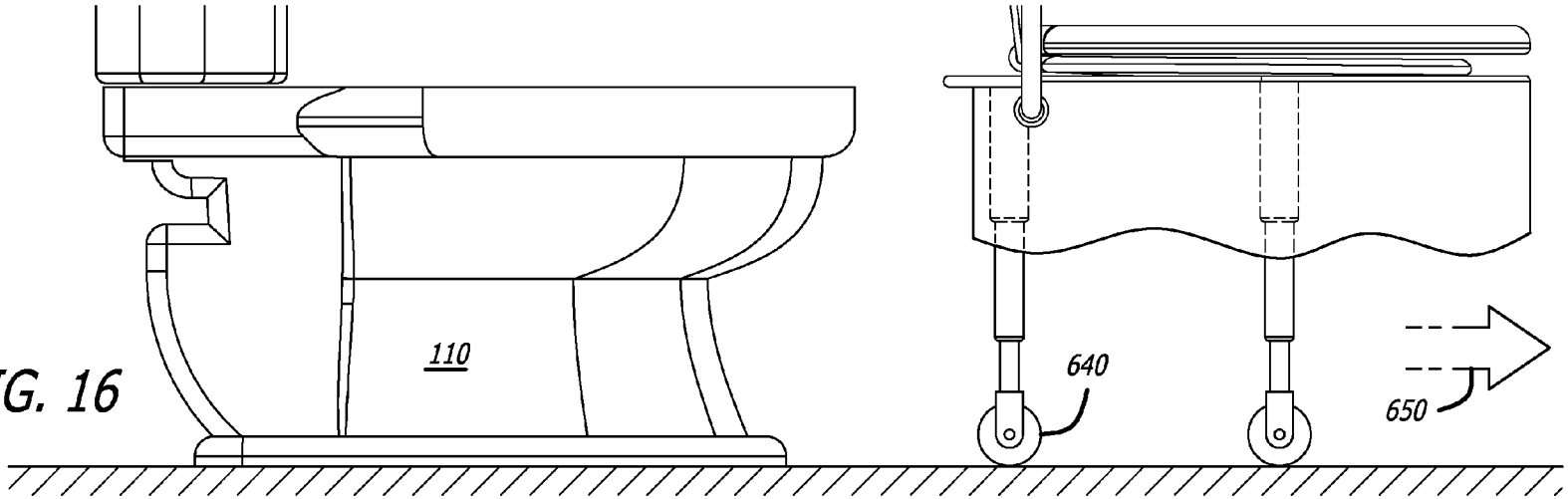
FIG. 16 is a view similar to that of FIG. 15 showing the chair assembly with the casters unlocked, being rolled away from the toilet for use in a toilet-remote chair mode

To assist in the positioning and repositioning of the chair assembly relative to a toilet and to desired remote chair locations, the legs 260 can have lockable casters 640, as shown in FIGS. 15 and 16, for example. This allows the chair assembly to be easily rolled into place over a toilet bowl as shown in FIG. 15, and then later rolled to a remote location as shown by the arrow 650 in FIG. 16.

Figure 18:
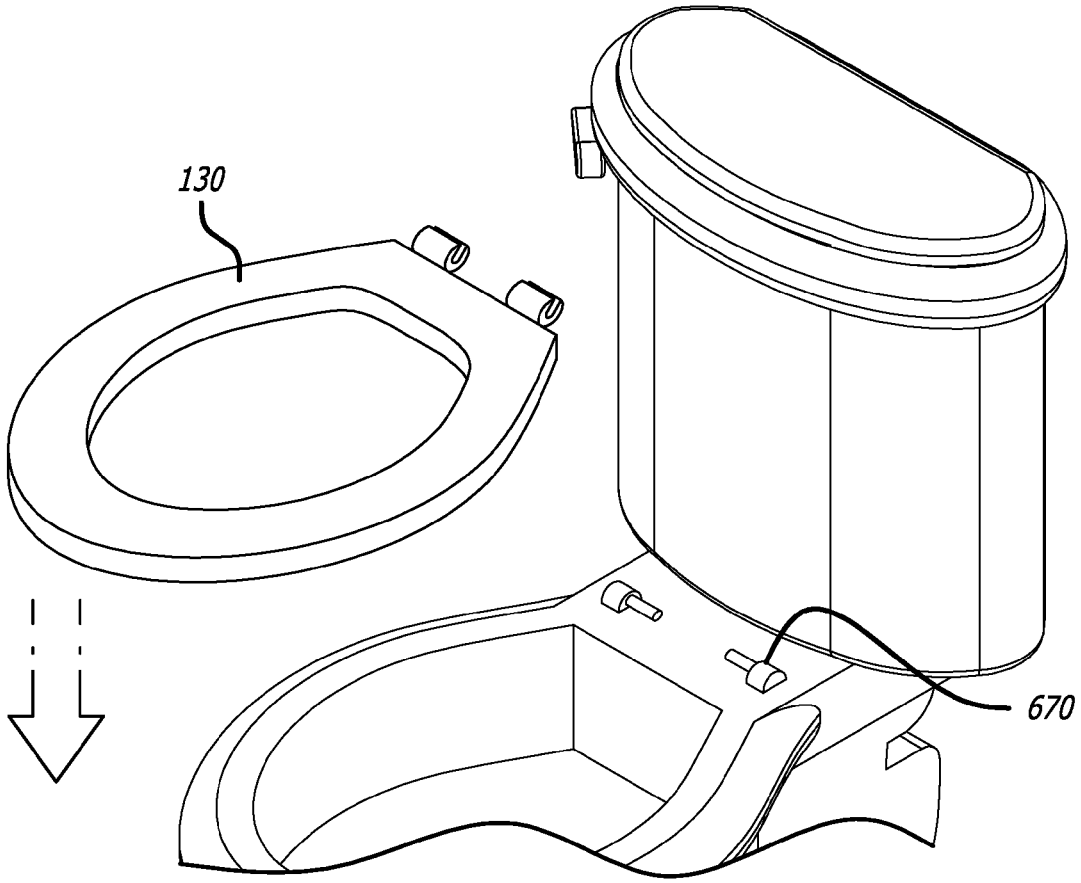
FIG. 18 is a top front perspective view showing the removed toilet seat of FIG. 17 being attached to the toilet of FIG. 16, for example, after the chair assembly has been moved away from the toilet.

The toilet 110 of FIGS. 1 and 15, for example, does not have a toilet seat to provide for a better fit of the chair assembly over the toilet bowl. Thus, when the chair assembly is moved away from the toilet, as shown in FIG. 16, the toilet left behind does not have a toilet seat. Advantageously, the toilet seat 130 can be removed from the chair assembly as shown by the arrow 654 in FIG. 17. And the removed toilet seat can be clipped 660 onto the hardware 670 of the toilet, as can be understood from FIGS. 18-20.

Figure 22:
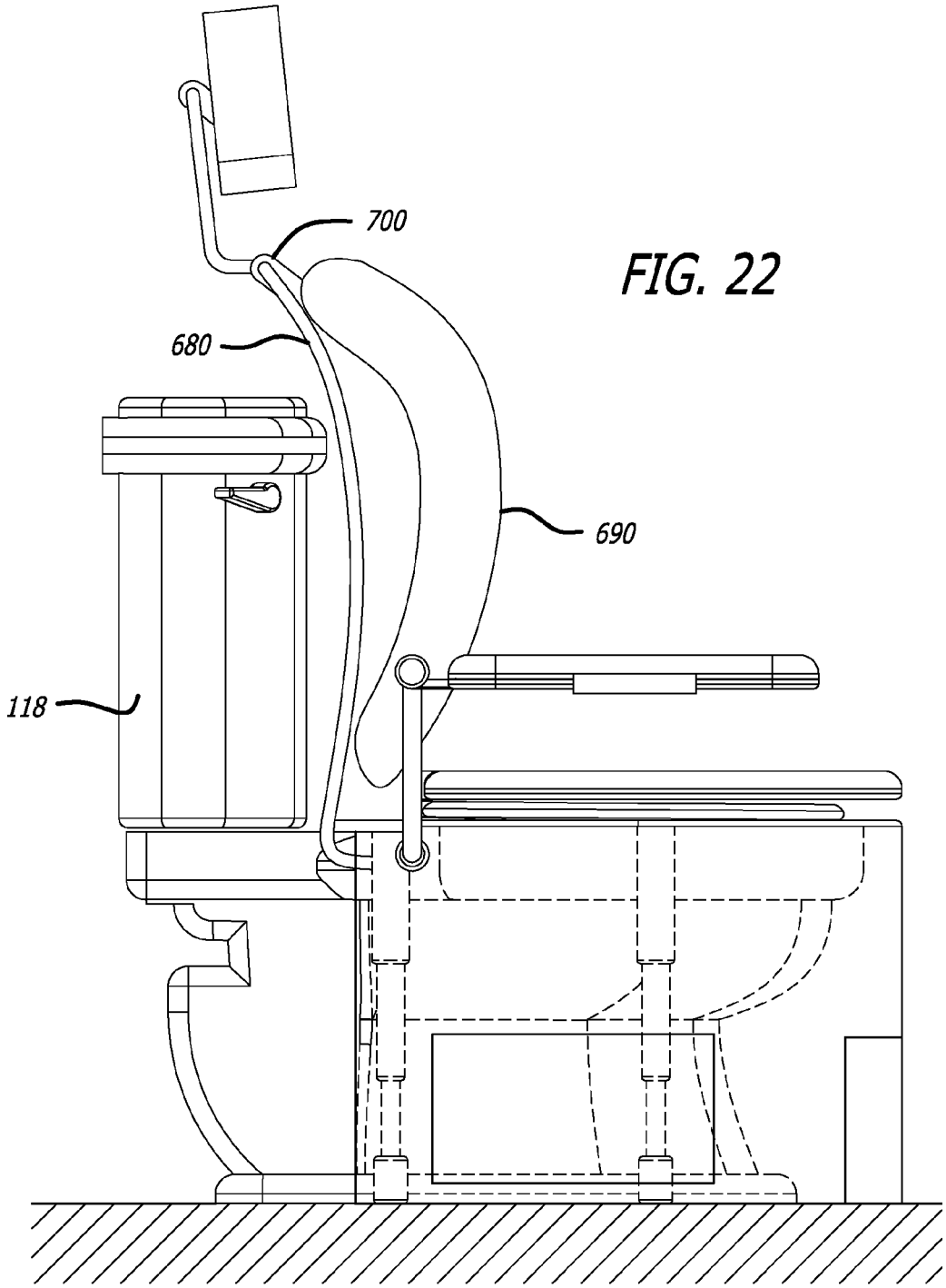
FIG. 22 is a side elevational view of another chair assembly of the disclosure positioned over a toilet, in a chair mode and having a curved backrest and a headrest positioned over the tank of the toilet; the curved frame allows for the attachment point of the backrest to the cross bar of the frame to be positioned further back, over the toilet tank, to allow for curvature in the backrest that does not obstruct access to the seating area or position a seated user too far forward.

FIG. 22 shows that the frame 680 can have a curved configuration. This figure also shows that the backrest 690 is also curved. Thus, the top 700 of the frame is above the tank 118 of the toilet. This arrangement allows for the backrest 690 to have additional curvature without impeding on the availability of the surface area of the chair seat lid 140 or the toilet seat 130. If the backrest 690 has a large convex curvature (lumbar support, for example), it may extend forward far enough that, without such a curvature in the frame, it would obstruct a seated user's access to the full seating surface area of the lid or the toilet seat. Thus the curved frame 680 allows for the backrest 690 to attach further back so the foremost point of the backrest (the user-facing curvature) does not extend forward so as to be on top of or over the lid or seat area.

Figure 23:
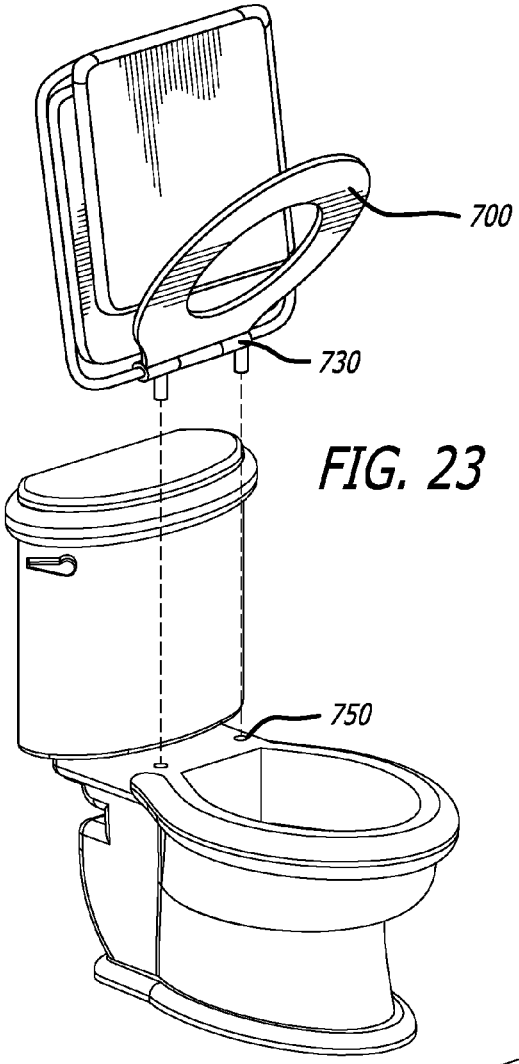
FIG. 23 is a perspective view of another chair (or frame) assembly of the disclosure in a separated position relative to a toilet.
Figure 24:
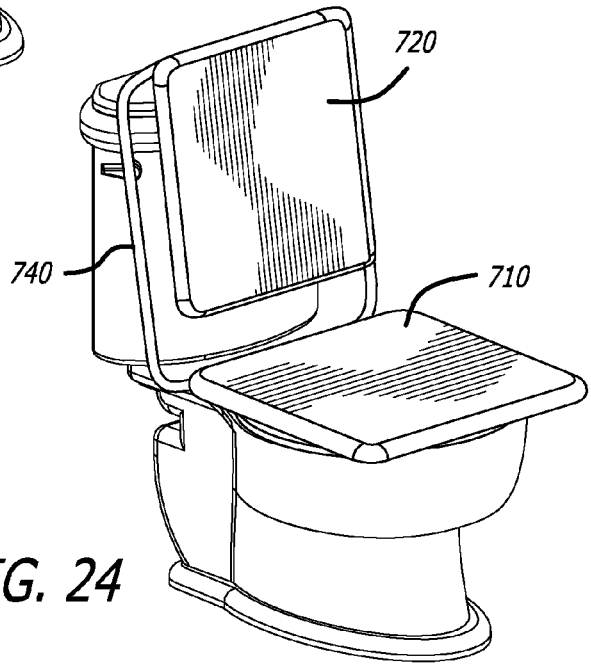
FIG. 24 is a view similar to FIG. 23 showing the assembly attached to the toilet fixture and with the assembly in a chair mode.

Instead of making for an entire chair assembly with a support platform, the disclosure can take the form of a chair or seat assembly as shown in FIGS. 23-26. This simpler and cheaper construction still provides for a chair mode as depicted in FIG. 24 with the toilet seat 700 on the bowl, the chair seat lid 710 on the toilet seat (to define a chair seating surface) and the backrest 720 (which a typical toilet does not have) generally upright and between the toilet tank and the bowl.

The toilet seat and the lid are connected by a hinge 730 to a support frame 740 of the assembly. And the backrest is attached to an opposite upper bar of the support frame by another hinge. The assembly can be attached to existing hardware 750 of the toilet with the toilet's seat removed, as depicted in FIG. 23.

Figure 25:
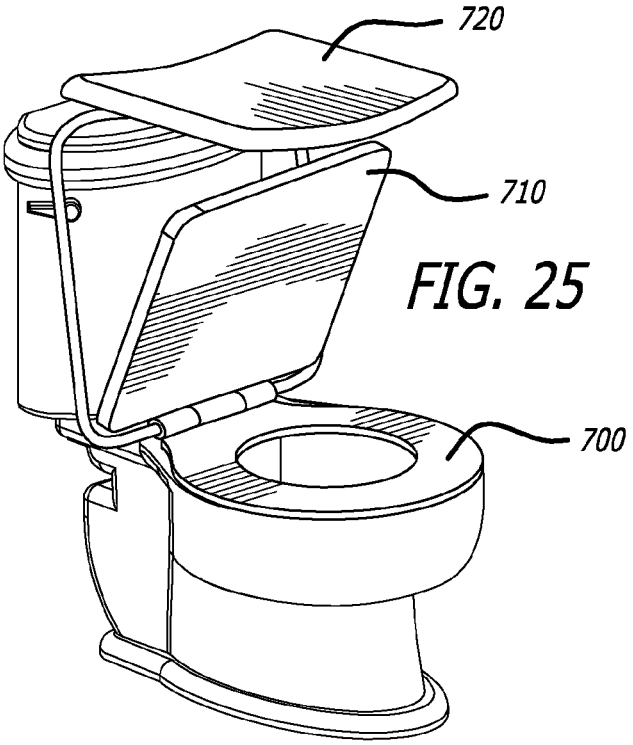
FIG. 25 is a view similar to FIG. 24 showing the assembly being positioned into a toilet-use mode.
Figure 26:
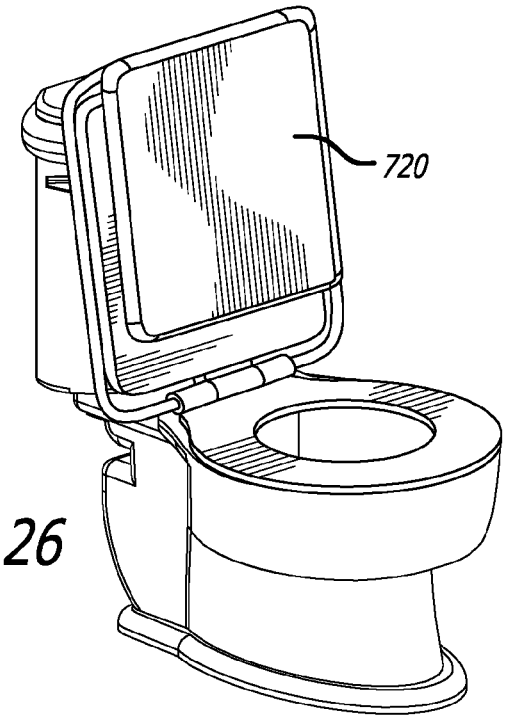
FIG. 26 is a view similar to FIG. 25 showing the assembly in the toilet-use mode.

Then to reconfigure the assembly into the toilet-use mode the backrest 720 is lifted and the lid 710 is lifted up behind the frame 740, as shown in FIG. 25. Then with the backrest 720 adjacent to the toilet tank, the backrest is lowered to an upright backrest position as shown in FIG. 26, whereby the user can sit on the exposed toilet seat 700 with his back resting comfortably against the cushioned backrest.

Similar to the previously-discussed embodiments, the assembly can be positioned in a standing male urination mode with the backrest 720 in a raised substantially horizontal position and the toilet seat 700 in a raised generally vertical or a little past vertical position. (A less desirable configuration can be with the backrest sandwiched between the raised toilet seat and the raised lid, similar to the relationship of FIG. 23.)

Figure 19:
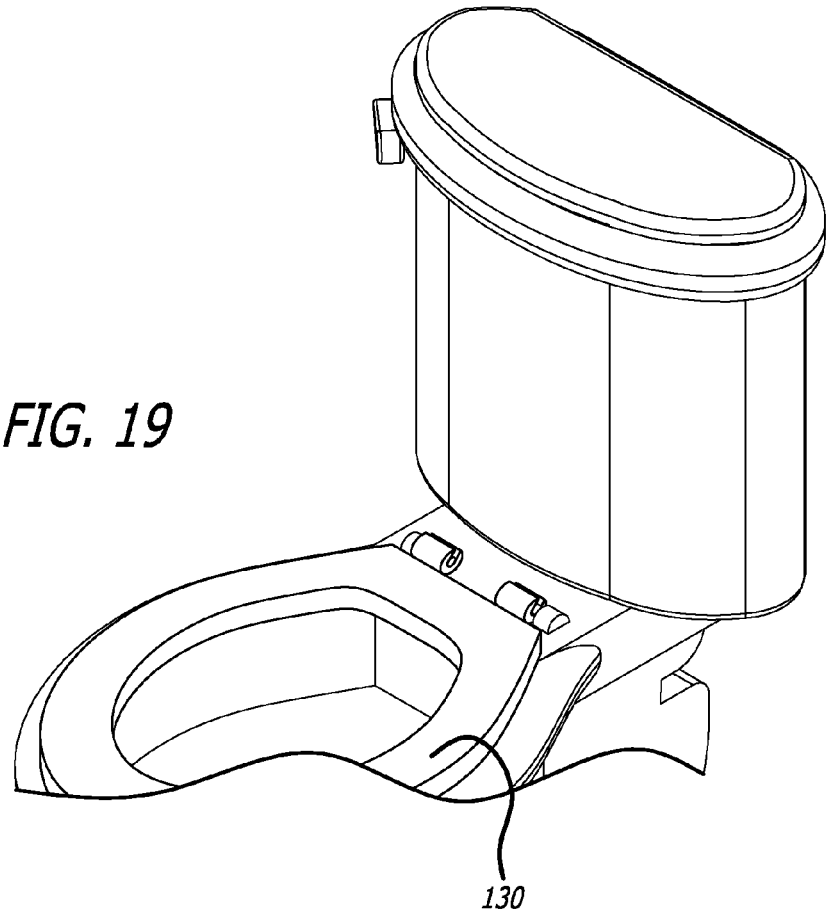
FIG. 19 is a view similar to FIG. 18 showing the toilet seat attached to the toilet.
Figure 20:
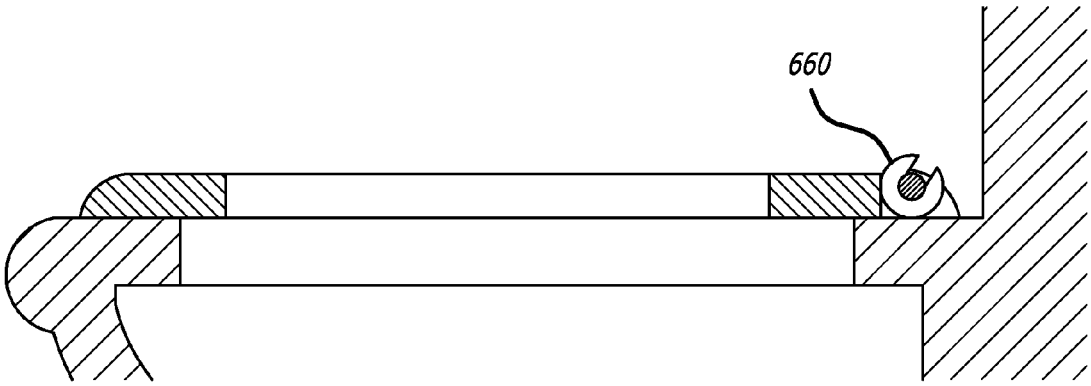
FIG. 20 is a cross-sectional view of FIG. 19 showing the attachment of the toilet seat to the toilet hardware.
Figure 27:
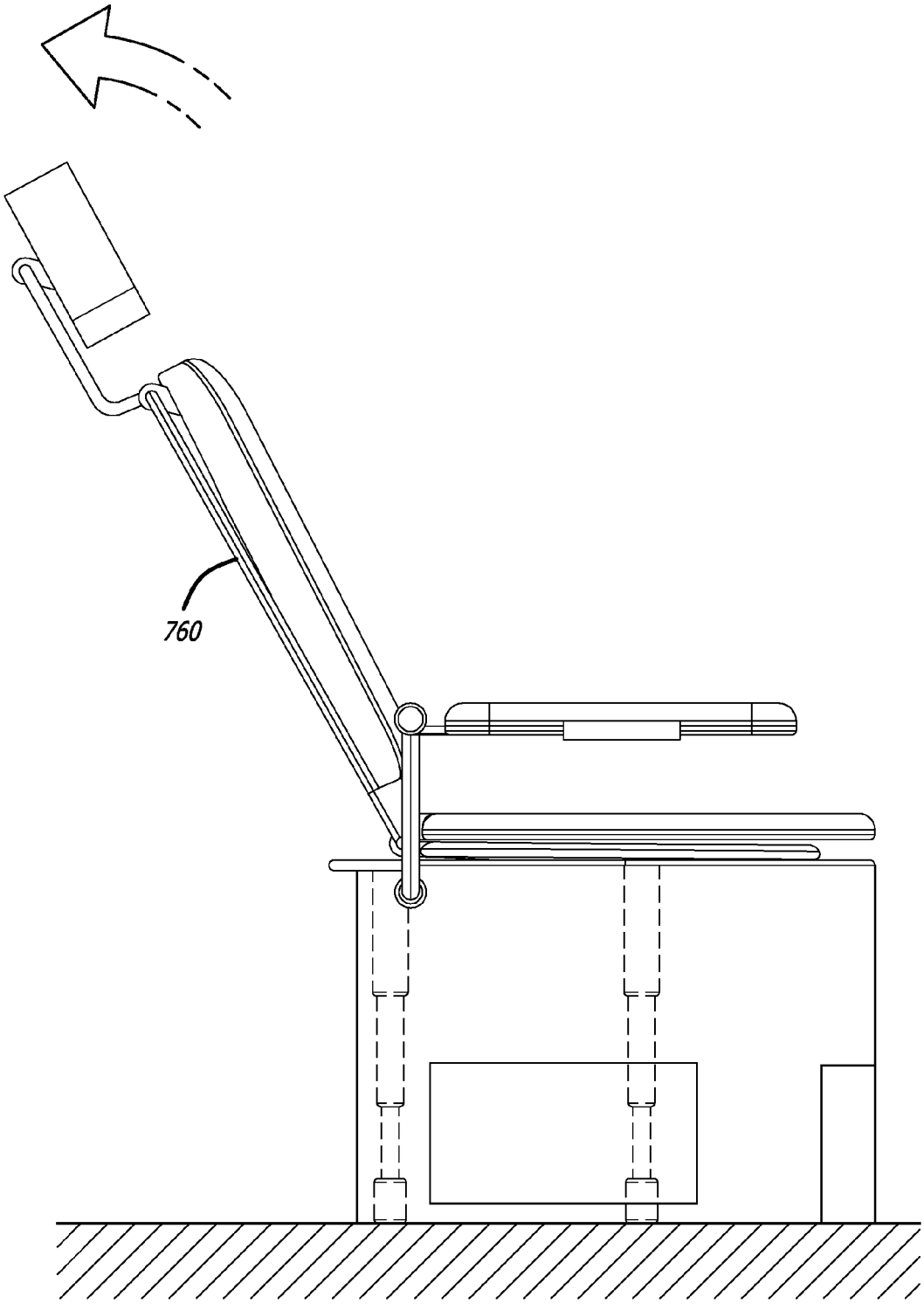
FIG. 27 is a side elevational view of a chair assembly of the disclosure in a remote position, in a chair mode and with the backrest thereof in a reclined position.

A chair assembly of the present disclosure can be used as a medical device for people who are unable to stand from a seated position, moving to the bathroom and sitting on a toilet. This chair assembly can have the locking casters as shown in FIGS. 15 and 16. When the chair assembly is in a remote chair location the backrest, toilet seat and chair seat lid are in the relative position as best shown in FIG. 1 and the toilet seat is in the position as best shown in FIG. 19. When the chair is positioned over a toilet and in a toilet-use mode they are in the relative position as best shown in FIG. 14. This chair assembly can optionally be equipped with the reclining backrest capability as shown in FIG. 27 at 760. The equipment to move the backrest from an upright position to a releasable reclined position for example can be a lever which allows the amount of recline to be adjusted through a series of notches set at predetermined angles, or a turnable knob which allows the recline to be adjusted at a custom angle via a friction hinge.

Figure 9A:
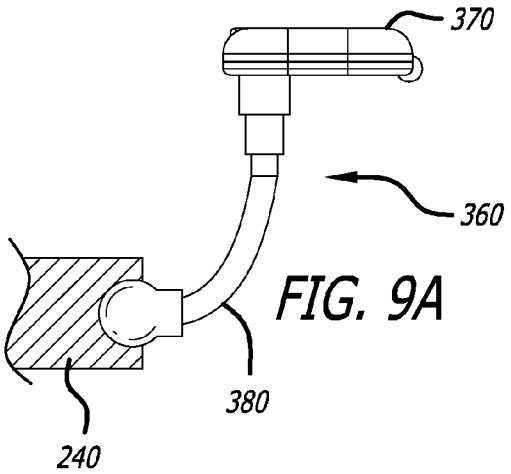
FIG. 9A is a front view of one of the arms of a chair assembly of the disclosure.
Figure 9B:
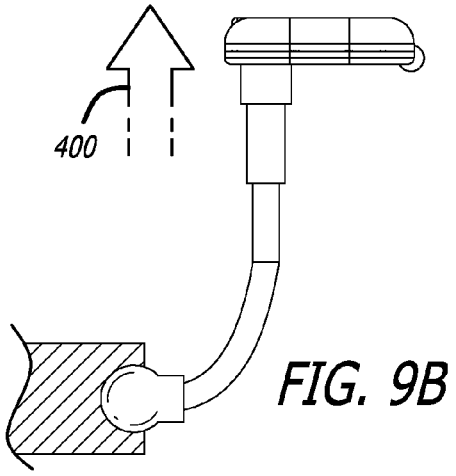
FIG. 9B is a view similar to FIG. 9A showing the armrest thereof in a raised position.
Figure 9C:
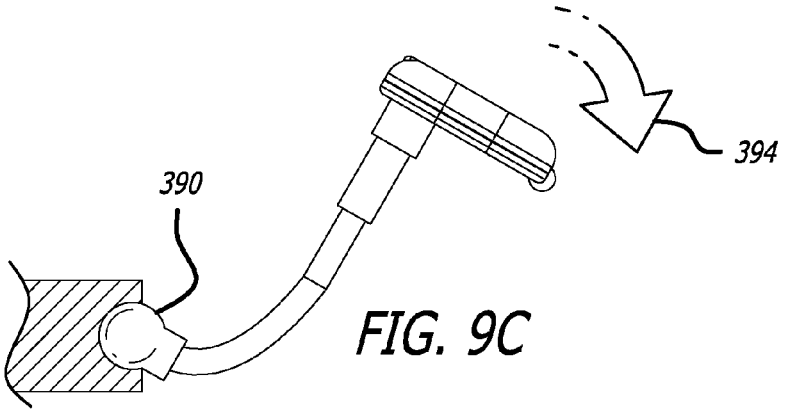
FIG. 9C is a view similar to FIG. 9B showing the armrest in a tilted position.

A preferred embodiment of the chair assembly can include: the foldout footrest of FIGS. 5-7; the tilt-out side compartment of FIG. 6 on one side; the pullout compartment with lift-up and pivot tray of FIGS. 21A-C on the other side; the roll-out, fold-out tray of FIG. 8 on both sides of the chair; the telescoping legs with lockable casters of FIGS. 15-16; the curved frame with attachment point over the toilet tank, curved backrest and head rest of FIG. 22; the arms having the repositionable capabilities as shown in FIGS. 9A-C; the telescoping arms having the up-down positioning capabilities of FIGS. 14 and 21A; the lift-up toilet seat and lift-up backrest of FIG. 13B; the toilet-use mode of FIG. 14 with the backrest in the lifted position; the removable toilet seat of FIGS. 17-20; the half-length skirt of FIG. 21A; and the footrest of FIGS. 5-6 positioned at the higher position as shown in FIG. 21A.

Although the present inventions have been described in terms of preferred and alternative embodiments above, numerous modifications and/or additions to the above-described embodiments would be readily apparent to one skilled in the art. The embodiments can be defined as methods of use or assembly carried out by anyone, any subset of or all of the components and/or users; as systems of one or more components in a certain structural and/or functional relationship; and/or as subassemblies or sub-methods. The inventions can include each of the individual components separately. However, it is intended that the scope of the present inventions extend to all such modifications and/or additions and that the scopes of the present inventions are limited solely by the claims set forth herein.

Individual elements or features of a particular aspect of the present teachings are generally not limited to that particular aspect, but, where applicable, are interchangeable and can be used in other aspects, even if not specifically shown or described. The same may also be varied in many ways. Such variations are not to be regarded as a departure from the present teachings, and all such modifications are intended to be included within the scope of the present teachings.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including" and "having" are inclusive and therefore specify the presence of stated features, integers, steps, operations, elements and/or components, but do not preclude the presence or addition of one or more other features, integers, steps, operations, elements, components and/or groups thereof. The method steps, processes and operations described herein are not to be construed as necessarily requiring their performance in the particular order discussed or illustrated, unless specifically identified as an order of performance. It is also to be understood that additional or alternative steps may be employed.

Although the terms first, second, third and so forth may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second" and other numerical terms when used herein do not imply a sequence or order unless clearly indicated by the context. Thus, a first element, component, region, layer or section discussed below can be termed a second element, component, region, layer or section without departing from the aspects of the present teachings.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (such as "between" versus "directly between," and "adjacent" versus "directly adjacent"). As used herein, the term "and/or" includes any and all combinations of one or more of the associated listed items.

Spatially relative terms, such as "inner," "outer," "beneath," "below," "lower," "upper," "above," "forward," "rearward," "front" and "back" may be used herein for ease of description to describe one element's or feature's relationship to another, but the disclosure is intended to encompass different orientations of the appliance in use or operation in addition to the orientation depicted in the figures. For example, if the appliance in the figures is turned over, elements described as "below" or "beneath" other elements or features would then be oriented "above" the other elements or features. Thus, the example term "below" can encompass both an orientation of above and below. The device may be otherwise oriented (rotated ninety degrees or at other orientations) and the spatially relative descriptors used herein interpreted accordingly.

What is claimed is:

1. A chair assembly, comprising:

a toilet seat;

a chair seat lid;

a backrest;

the toilet seat, the lid and the backrest being connected relative to one another such that they are positionable in alternative chair and toilet-use modes;

the chair mode includes the lid being positioned down on the toilet seat and the backrest being in a backrest position;

the toilet-use mode includes the toilet seat being in an operative down position and the backrest being in a backrest position with the lid being behind the backrest;

a frame having a first hinge at an upper portion thereof operatively connected to the backrest and a second hinge at a lower portion thereof operatively connected to the toilet seat and to the lid; and the assembly is configured such that when operatively positioned relative to a toilet the frame is at a small backward angle from the vertical.

2. The assembly of claim 1 wherein the first hinge is a flip-up friction hinge and the second hinge is a friction hinge.

3. The assembly of claim 1 further comprising a plurality of telescoping legs connected to the frame.

4. The assembly of claim 3 wherein the telescoping legs have bottom lockable casters.

5. The assembly of claim 3 further comprising a platform supported by the plurality of telescoping legs.

6. The assembly of claim 5 wherein the frame is attached to the platform.

7. The assembly of claim 5 further comprising left and right chair arms attached to the platform, at least one of which is user-repositionable relative to the platform.

8. The assembly of claim 1 wherein with the lid in a lifted position, the toilet seat can be removed and the lid then lowered to form a chair for a user.

9. The assembly of claim 1 further comprising: a platform to which at least one of the toilet seat, lid and backrest is attached; a telescoping connector arm connected at one end by a ball joint socket to the platform; and an armrest connected to an opposite end of the connector arm.

10. The assembly of claim 9 wherein the armrest has a flip-out construction including a base panel and an outer rotatable top panel.

11. The assembly of claim 10 wherein the armrest includes a tray foldout configured to fold out from the base panel to be positioned over a lap of a person sitting in the chair assembly.

12. The assembly of claim 1 further comprising: a platform to which at least one of the toilet seat, lid and backrest is attached; a connector arm attached at one end to the platform; and an armrest connected to an opposite end of the connector arm and pivotal about a horizontal lateral axis between an armrest operative, generally horizontal and longitudinal position and a raised, generally vertical position.

13. A chair assembly, comprising:

a toilet seat;

a chair seat lid;

a backrest;

the toilet seat, the lid and the backrest being connected relative to one another such that they are positionable in alternative chair and toilet-use modes;

the chair mode includes the lid being positioned down on the toilet seat and the backrest being in a backrest position;

the toilet-use mode includes the toilet seat being in an operative down position and the backrest being in a backrest position with the lid being behind the backrest;

a platform to which a frame is connected;

a skirt extending down from the platform and configured to at least partially hide a toilet with the assembly in an operative position over the toilet; and at least one of the toilet seat, lid and the backrest being attached to the frame.

14. The assembly of claim 13 further comprising a plurality of telescoping legs attached to the platform.

15. The assembly of claim 14 wherein the telescoping legs have bottom lockable casters.

16. The assembly of claim 13 further comprising left and right chair arms attached to the platform, at least one of which is user-repositionable relative to the platform.

17. The assembly of claim 13 wherein with the lid in a lifted position, the toilet seat can be removed and the lid then lowered to form a chair for a user.

18. The assembly of claim 13 wherein the toilet seat and/or the lid is removably attached to a lower portion of the frame, and the backrest is attached to an upper portion of the frame.

19. A chair assembly, comprising:

a platform;

a chair seat attached to the platform;

a backrest attached to the platform;

a footrest supported down from the platform and positionable between a non-use position and an operative position that is extended out from, rotated relative to and lifted relative to the non-use position; and a skirt depending down from the platform and the footrest forming a part of the skirt when the footrest is in the non-use position.

20. The assembly of claim 19 wherein the footrest is configured such that when being operatively repositioned from the non-use position to the operative position, the footrest is positioned in a first extended-out position extended horizontally out from the non-use position and with the footrest in a vertical orientation, then in a second extended position extended horizontally out from the non-use position and with the footrest in a rotated horizontal orientation, and then in a third extended-out position in a raised position relative to the second extended position and with the footrest in the rotated horizontal orientation.

21. A chair assembly, comprising:

a chair seat;

a backrest connected to the chair seat;

a toilet seat;

a footrest having a footrest surface and an opposite surface oppositely disposed with respect to the footrest surface;

the footrest being connected to and movable with respect to the chair seat between a storage position and an operative position;

the footrest when in the storage position being generally vertically disposed and the opposite surface being disposed generally away from the toilet seat;

the footrest when in the operative position being generally horizontally disposed and the footrest surface being generally upwardly disposed; and the footrest being configured such that when in an intermediate repositioning position operatively between the storage position and the operative position, the footrest is extended horizontally out a distance from the storage position and is generally vertically disposed.

22. The assembly of claim 21 wherein the intermediate repositioning position defines a first position, and the footrest is configured such that when in a second position the footrest is extended horizontally out the distance from the storage position and is generally horizontally disposed.

23. The assembly of claim 21 wherein the second position is the operative position.

24. The assembly of claim 21 wherein the operative position is above the second position.

25. A method for a chair assembly having a chair seat, a back rest, a toilet seat and a footrest, comprising:

the footrest having a footrest surface and an opposite surface oppositely disposed with respect to the footrest surface;

moving the footrest with respect to the chair seat between a storage position and an operative position;

the footrest when in the storage position being generally vertically disposed and the opposite surface being disposed generally away from the toilet seat;

the footrest when in the operative position being generally horizontally disposed and the footrest surface being generally upwardly disposed; and the moving from the storage position to the operative position including moving the footrest horizontally from the storage position out to an extended position away from and generally vertically disposed, and when in the extended position rotating the footrest so as to be in a generally vertically-disposed extended position.

26. The method of claim 25 wherein the generally vertically-disposed extended position is the operative position.

27. The method of claim 25 wherein the moving from the storage position to the operative position further includes moving the footrest from the generally vertically-disposed extended position upwardly to the operative position.

* * * * *